US011334014B2

(12) United States Patent
Yagi et al.

(10) Patent No.: US 11,334,014 B2
(45) Date of Patent: May 17, 2022

(54) IMAGE FORMING APPARATUS

(71) Applicant: CANON KABUSHIKI KAISHA, Tokyo (JP)

(72) Inventors: Yasutaka Yagi, Shizuoka (JP); Ken Yokoyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/211,208

(22) Filed: Mar. 24, 2021

(65) Prior Publication Data

US 2021/0302885 A1 Sep. 30, 2021

(30) Foreign Application Priority Data

Mar. 27, 2020 (JP) ..... JP2020-059019
Jan. 18, 2021 (JP) ..... JP2021-006083

(51) Int. Cl.
*G03G 15/00* (2006.01)
*G03G 15/16* (2006.01)

(52) U.S. Cl.
CPC ..... *G03G 15/5054* (2013.01); *G03G 15/161* (2013.01)

(58) Field of Classification Search
CPC ..... G03G 15/5054; G03G 15/161
See application file for complete search history.

(56) References Cited

U.S. PATENT DOCUMENTS 6,944,418 B2 9/2005 Tamaoki
6,956,594 B2 10/2005 Iida et al.
6,965,747 B2 11/2005 Funamizu et al.
2007/0201897 A1* 8/2007 Maeda ..... G03G 15/161 399/101

FOREIGN PATENT DOCUMENTS

JP 2004-117602 A 4/2004
JP 2004-118076 A 4/2004
JP 2004-151588 A 5/2004

* cited by examiner

*Primary Examiner* — Clayton E. LaBalle
*Assistant Examiner* — Michael A Harrison
(74) *Attorney, Agent, or Firm* — Venable LLP

(57) ABSTRACT

An image forming apparatus includes an image forming portion configured to form a toner image on an image bearing member; an intermediate transfer member onto which the toner image is transferred from the image bearing member in a primary transfer portion to form an image portion; and a control portion configured to perform control to form a toner image for lubrication in a non-image portion of the intermediate transfer member onto which the toner image for a print image based on image information is not to be formed. In a state in which the non-image portion is to be formed downstream of the image portion in a movement direction of the surface of the intermediate transfer member, the control portion performs control to change a size of a region for forming the toner image for lubrication based on the image information.

19 Claims, 13 Drawing Sheets

IMAGE FORMING APPARATUS

BACKGROUND OF THE DISCLOSURE

Field of the Disclosure

The present disclosure relates to an image forming apparatus, for example, a copying machine, a printer, or a facsimile machine which uses an electrophotographic system or an electrostatic recording system.

Description of the Related Art

Hitherto, as an image forming apparatus using, for example, an electrophotographic system, which is represented by a laser printer or a copying machine, there is an image forming apparatus of an intermediate transfer system in which a toner image formed on an image bearing member is primarily transferred onto an intermediate transfer member and is then secondarily transferred to a recording material, for example, a recording sheet. As the intermediate transfer member, an intermediate transfer belt formed of an endless belt capable of rotating in contact with the image bearing member is often used.

One of the challenges for increasing image quality in such an image forming apparatus is to improve primary transferability. Specifically, the primary transferability is improved by reducing an amount of primary transfer residual toner remaining on the image bearing member when the toner image formed on the image bearing member is primarily transferred onto the intermediate transfer belt. In order to improve the primary transferability, there is known a technology in which a speed difference (circumferential speed difference) is provided between a circumferential speed of the image bearing member and a circumferential speed of the intermediate transfer belt.

In this case, when a circumferential speed difference is provided between the circumferential speed of the image bearing member and the circumferential speed of a surface of the intermediate transfer belt, a frictional force based on a difference in friction coefficient between the two circumferential speeds is generated. As a result, the frictional force changes depending on whether or not toner functioning as a lubricant is present between the image bearing member and the intermediate transfer belt, and the rotation speed of the image bearing member varies. Thus, exposure of the image bearing member to light may be blurred to cause a streaky image failure (exposure blur) to occur at a leading edge portion of an image.

As a technology for suppressing the above-mentioned exposure blur, there is proposed a technology involving forming a toner image for lubrication in a non-image portion (Japanese Patent Application Laid-Open No. 2004-118076).

However, in the related-art technology involving forming a toner image for lubrication, the toner image for lubrication is formed at a predetermined coverage rate over an entire width of an image region in terms of a main scanning direction. This has caused a problem in that a consumption amount of toner for forming the toner image for lubrication may increase.

SUMMARY OF THE DISCLOSURE

Thus, the present disclosure has an object to suppress an occurrence of exposure blur while suppressing a consumption amount of toner for forming a toner image for lubrication.

According to an aspect of the disclosure, there is provided an image forming apparatus, comprising: an image forming portion configured to form a toner image on an image bearing member; an intermediate transfer member which is movable and configured to form a primary transfer portion by being brought into contact with the image bearing member, and onto which the toner image primarily transferred from the image bearing member in the primary transfer portion is to be transferred to form an image portion; and a control portion configured to perform control to form a toner image for lubrication in a non-image portion being a portion of a surface of the intermediate transfer member onto which the toner image for a print image based on image information is not to be formed, wherein in a state in which the non-image portion is to be formed on a downstream side of the image portion with respect to a movement direction of the surface of the intermediate transfer member, the control portion performs control to change a size of a region for forming the toner image for lubrication based on the image information.

Further features of the present disclosure will become apparent from the following description of exemplary embodiments with reference to the attached drawings.

DESCRIPTION OF THE EMBODIMENTS

Now, an image forming apparatus according to the present disclosure is described in detail with reference to the drawings.

First Embodiment

1. Overall Configuration and Operation of Image Forming Apparatus

Figure 1:
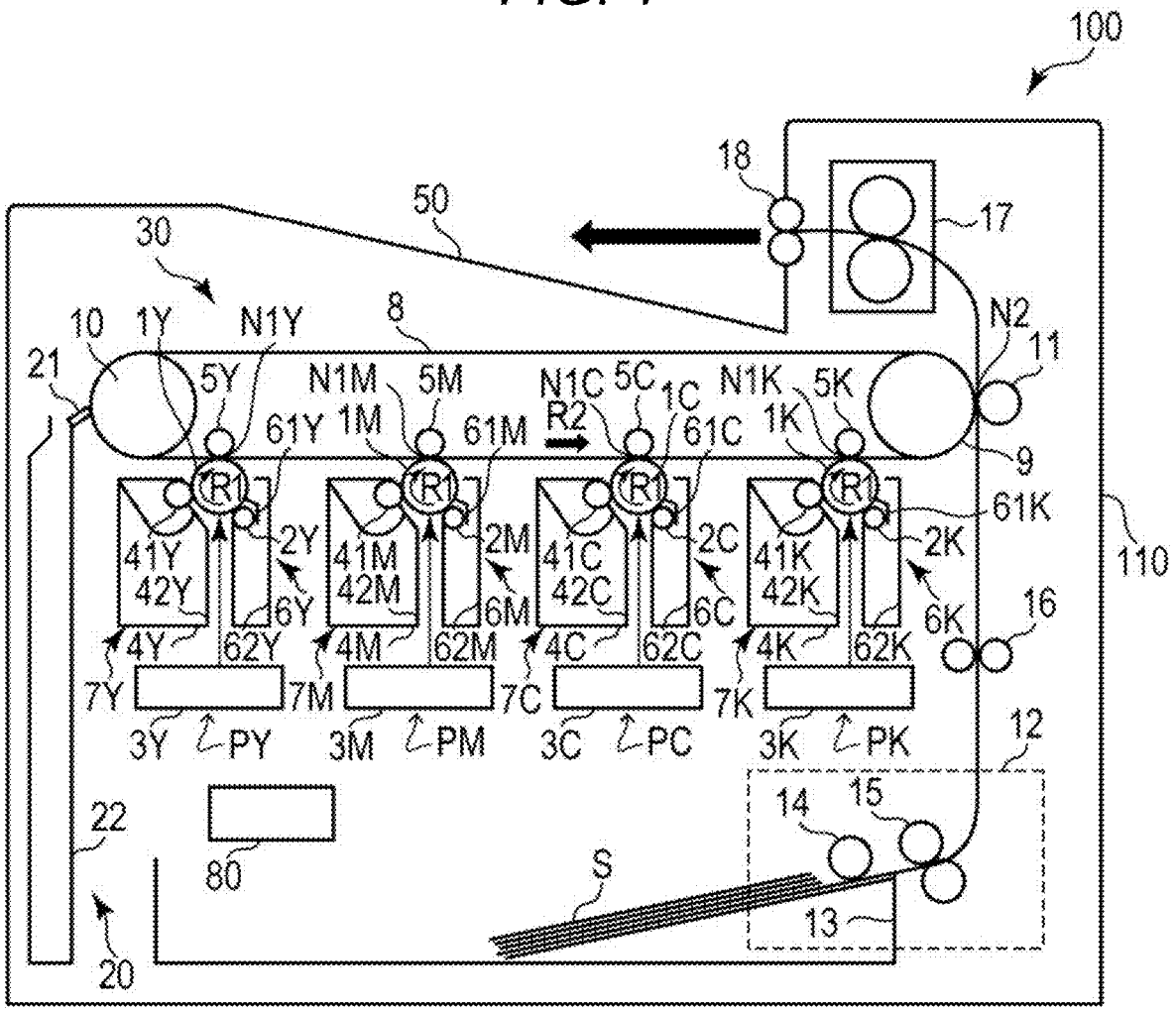
FIG. 1 is an outline cross-sectional view of an image forming apparatus.

FIG. 1 is an outline cross-sectional view of an image forming apparatus 100 according to a first embodiment of the present disclosure. The image forming apparatus 100 according to the first embodiment is a tandem type (in-line system) laser beam printer employing an intermediate transfer system, which is capable of forming a full-color image using an electrophotographic system.

The image forming apparatus 100 includes, as a plurality of image forming portions (stations), a first image forming portion PY configured to form a yellow (Y) toner image, a second image forming portion PM configured to form a magenta (M) toner image, a third image forming portion PC configured to form a cyan (C) toner image, and a fourth image forming portion PK configured to form a black (K) toner image. Components having the same or corresponding functions or configurations in the image forming portions PY, PM, PC, and PK may be collectively described without the suffixes Y, M, C, and K of the reference symbols, which denote respective colors for which the components are provided. In the first embodiment, each image forming portion P includes a photosensitive drum 1 (1Y, 1M, 1C, 1K), a charge roller 2 (2Y, 2M, 2C, 2K), an exposure device 3 (3Y, 3M, 3C, 3K), a developing device 4 (4Y, 4M, 4C, 4K), a primary transfer roller 5 (5Y, 5M, 5C, 5K), and a drum cleaning device 6 (6Y, 6M, 6C, 6K), which are described later.

The photosensitive drum 1, which is a rotatable electrophotographic photosensitive member (photosensitive member) having a drum shape (cylinder shape) and serves as an image bearing member configured to bear a toner image, is driven to rotate at a predetermined rotation speed (circumferential speed) (described later) in a direction indicated by an arrow R1 of FIG. 1 (clockwise direction). A surface of the photosensitive drum 1 being rotated is charged by the charge roller 2, which is a charging member having a roller shape and serves as a charging unit, to a predetermined potential with a predetermined polarity (negative polarity in the first embodiment). At the time of charging, a predetermined charging voltage (charging bias) is applied to the charge roller 2. The surface of the photosensitive drum 1 having been charged is scanned and exposed to light in accordance with an image signal by the exposure device (laser scanner unit) 3 serving as an exposure unit. As a result, an electrostatic latent image (electrostatic image) is formed on the photosensitive drum 1. The electrostatic latent image formed on the photosensitive drum 1 is developed (visualized) by the developing device 4 serving as a developing unit using supplied toner serving as developer, thereby forming a toner image on the photosensitive drum 1. The developing device 4 includes a developing roller 41 and a toner container 42. The developing roller 41 serves as a developer carrying member. The toner container 42 is configured to store toner. At the time of developing, a predetermined developing voltage (developing bias) is applied to the developing roller 41. In the first embodiment, toner having been charged to the same polarity (in the first embodiment, negative polarity) as the charging polarity of the photosensitive drum 1 adheres to an exposed portion on the photosensitive drum 1 which is reduced in absolute value of the potential by being uniformly charged and thereafter exposed to light (reversal development).

An intermediate transfer belt 8 which is formed of an endless belt is arranged so as to be movable (rotatable) in contact with the respective photosensitive drums 1 of the image forming portions P. The intermediate transfer belt 8 is an example of an intermediate transfer member which is configured to allow the toner image primarily transferred from the image bearing member to be conveyed so as to be secondarily transferred to the transfer material. The intermediate transfer belt 8 is stretched around a drive roller 9 and a driven roller 10 being a plurality of tensioning rollers (support members), and is tensioned with a predetermined tensile force. The drive roller 9 is driven to rotate so that the intermediate transfer belt 8 is caused to rotate (move around) in a direction indicated by an arrow R2 of FIG. 1 (counterclockwise direction) at a circumferential speed (moving speed of the surface) corresponding to the circumferential speed (moving speed of the surface) of the photosensitive drum 1. In the first embodiment, the moving speed of the surface of the intermediate transfer belt 8 (circumferential speed or process speed) is 210 mm/sec. On an inner peripheral surface side of the intermediate transfer belt 8, primary transfer rollers 5, which are primary transfer members each having a roller shape and each serving as a primary transfer unit, are arranged so as to correspond to the respective photosensitive drums 1. The primary transfer rollers 5 are pressed toward the photosensitive drums 1 through intermediation of the intermediate transfer belt 8, and form primary transfer portions N1 at which the photosensitive drums 1 are held in contact with the intermediate transfer belt 8. The toner image formed on the photosensitive drum 1 as described above is primarily transferred at the primary transfer portion N1 onto the intermediate transfer belt 8 being rotated. At the time of primary transfer, a primary transfer voltage (primary transfer bias) which is a direct-current voltage having a polarity (in the first embodiment, positive polarity) opposite to an original charging polarity of the toner (charging polarity of the toner given at the time of developing) is applied to the primary transfer roller 5. For example, at the time of forming a full-color image, toner images of respective colors, that is, yellow, magenta, cyan, and black, which are formed on the respective photosensitive drums 1Y, 1M, 1C, and 1K, are primarily transferred in a sequential manner onto the intermediate transfer belt 8 in a superimposed state.

At a position opposed to the drive roller 9, which also serves as a secondary transfer opposed roller, on an outer peripheral surface side of the intermediate transfer belt 8, a secondary transfer roller 11 being a roller-type secondary transfer member serving as a secondary transfer unit is arranged. The secondary transfer roller 11 is pressed toward the drive roller 9 through intermediation of the intermediate transfer belt 8 to form a secondary transfer portion N2 at which the intermediate transfer belt 8 and the secondary transfer roller 11 come into contact with each other. The toner images formed on the intermediate transfer belt 8 as described above are secondarily transferred onto a transfer material S (recording material or sheet), for example, recording paper nipped between the intermediate transfer belt 8 and the secondary transfer roller 11 to be conveyed at the secondary transfer portion. During the secondary transfer, a secondary transfer voltage (secondary transfer bias) being a direct-current voltage having the polarity opposite to the original charging polarity of the toner (positive polarity in the first embodiment) is applied to the secondary transfer roller 11. The transfer material S is received in a transfer material cassette 13, is fed from the transfer material cassette 13 by a feed roller 14 of a feeding apparatus 12, and is conveyed by a conveyance roller pair 15 of the feeding apparatus 12 to a registration roller pair 16. Then, the transfer material S is fed by the registration roller pair 16 to the secondary transfer portion N2 in conformity with a timing of the toner images on the intermediate transfer belt 8.

The transfer material S having the toner images transferred thereon is conveyed to a fixing device 17 serving as a fixing unit. The fixing device 17 is configured to heat and pressurize the transfer material S bearing the unfixed toner images, to thereby fix (melt and adhere) the toner images to a surface of the transfer material S. After that, the transfer material S is delivered (output) by a delivery roller pair 18 to a delivery tray 50 provided outside an apparatus main body 110 of the image forming apparatus 100.

Further, primary transfer residual toner remaining on the photosensitive drum 1 without being transferred onto the intermediate transfer belt 8 during the primary transfer is removed from the photosensitive drum 1 and collected by the drum cleaning device 6 serving as a photosensitive member cleaning unit. The drum cleaning device 6 includes a drum cleaning blade 61 serving as a cleaning member and a collected toner container 62. The drum cleaning device 6 scrapes off the primary transfer residual toner from the surface of the photosensitive drum 1 being rotated with use of the drum cleaning blade 61, and stores the primary transfer residual toner in the collected toner container 62. Further, toner remaining on the intermediate transfer belt 8 without being transferred onto the transfer material S during the secondary transfer (secondary transfer residual toner) is removed from the intermediate transfer belt 8 and collected by a belt cleaning device 20 serving as an intermediate transfer member cleaning unit. The belt cleaning device 20 includes a belt cleaning blade 21 serving as a cleaning member and a collected toner container 22. The belt cleaning device 20 scrapes off the secondary transfer residual toner from the surface of the intermediate transfer belt 8 being rotated with use of the belt cleaning blade 21, and stores the secondary transfer residual toner in the collected toner container 22.

The image forming apparatus 100 also includes a control portion (controller) 80. The control portion 80 includes a CPU serving as an arithmetic operation control unit, a memory serving as a storage unit including a ROM and a RAM, and an input/output circuit configured to control input/output of a signal between the control portion 80 and each of the other portions. The control portion 80 is configured to comprehensively control operations of the portions of the image forming apparatus 100 by the CPU executing processing based on a program and data stored in the memory. The control portion 80 is also configured to control the portions of the image forming apparatus 100 to execute image formation based on image information input from an external apparatus, for example, an image reading device or a personal computer, connected to the image forming apparatus 100.

In the first embodiment, in each image forming portion P, the photosensitive drum 1 and process units, that is, the charge roller 2, the developing device 4, and the drum cleaning device 6 which act on the photosensitive drum 1 integrally construct a process cartridge 7 which is removably mounted to the apparatus main body 110. Further, in the first embodiment, the intermediate transfer belt 8, the drive roller 9, the driven roller 10, and the primary transfer rollers 5Y, 5M, 5C, and 5K integrally construct an intermediate transfer unit 30 which is removably mounted to the apparatus main body 110.

The toner used in the first embodiment is substantially spherical toner having an average particle diameter of from 5 μm to 8 μm (one-component nonmagnetic developer). In the first embodiment, two transfers in total including the primary transfer and the secondary transfer are performed, and hence spherical toner which is excellent in transferability is used as toner. The toner used in the first embodiment is manufactured by a polymerization method. The toner is formed into a substantially spherical shape because of the manufacturing method. Further, in the toner used in the first embodiment, wax is contained in a core. Styrene-butylacrylate is used for a binder resin layer on the core. Styrene-polyester is used for a resin layer being an outermost shell on the binder resin layer. Further, for the purpose of stabilizing the charging ability and providing lubricity, an external additive is added to the toner. As binder resin for toner, there may be used a vinyl-based copolymer made of styrene-based resin and acryl-based resin, or polyester resin.

2. Photosensitive Drum

Figure 2:
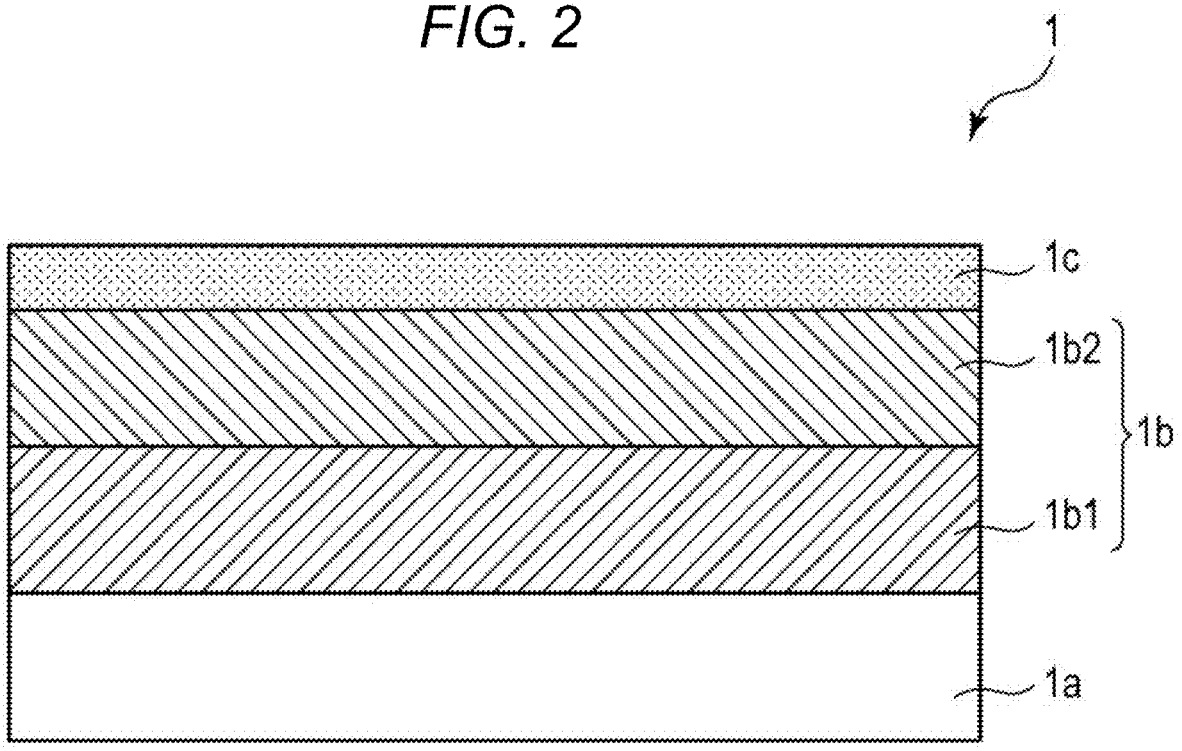
FIG. 2 is a schematic cross-sectional view of a photosensitive drum.

Next, the photosensitive drum 1 is further described. FIG. 2 is a schematic cross-sectional view for illustrating a layer configuration of the photosensitive drum 1.

In general, the photosensitive drum 1 includes a conductive support member 1*a* and a photosensitive layer 1*b* formed on the support member 1*a*. The photosensitive layer 1*b* may be a photosensitive layer of a single-layer type which contains a charge transporting substance and a charge producing substance in the same layer, or may be a photosensitive layer of a multi-layer type which is formed by laminating a charge producing layer 1*b*1 containing the charge producing substance and a charge transporting layer 1*b*2 containing the charge transporting substance. FIG. 2 is an illustration of a layer configuration of a photosensitive drum 1 of the multi-layer type. In the first embodiment, the photosensitive drum 1 of the multi-layer type is used. Further, a protective layer 1*c* may be provided on the photosensitive layer 1*b*. In the first embodiment, the protective layer 1*c* is provided to the photosensitive drum 1. A surface layer of the photosensitive drum 1 is a layer which is provided on the outermost side of the photosensitive drum 1. That is, the surface layer of the photosensitive drum 1 is a layer which is most apart from the support member 1*a* and has a surface for carrying toner. Thus, in the first embodiment, the surface layer of the photosensitive drum 1 corresponds to the protective layer 1*c*.

The surface layer of the photosensitive drum 1 in the first embodiment (protective layer 1*c* in the first embodiment) contains acrylic resin (polymer of acrylic ester or methacrylic ester). More specifically, the surface layer of the photosensitive drum 1 (protective layer 1*c* in the first embodiment) contains the acrylic resin as a main component. In the first embodiment, as the resin (binding resin) forming the protective layer 1*c*, there is used resin which is obtained by crosslinking an acrylic compound (monomer of acrylic resin) or a methacrylic compound (monomer of methacrylic resin) having an unsaturated bond through use of radiation such as an ultraviolet ray or an electron beam. Additives such as antioxidant, ultraviolet absorber, plasticizer, fluorine atom-containing resin particles, and a silicone compound may be added to the protective layer 1*c*.

The above-mentioned layers can be formed by applying application liquid for forming the layers to the surface of a layer below each of the layers. When the application liquid is to be applied, there can be used an application method such as a dip application method (dip coating method), a spray coating method, a spinner coating method, a roller coating method, a Meyer bar coating method, or a blade coating method.

3. Intermediate Transfer Belt

Figure 3:
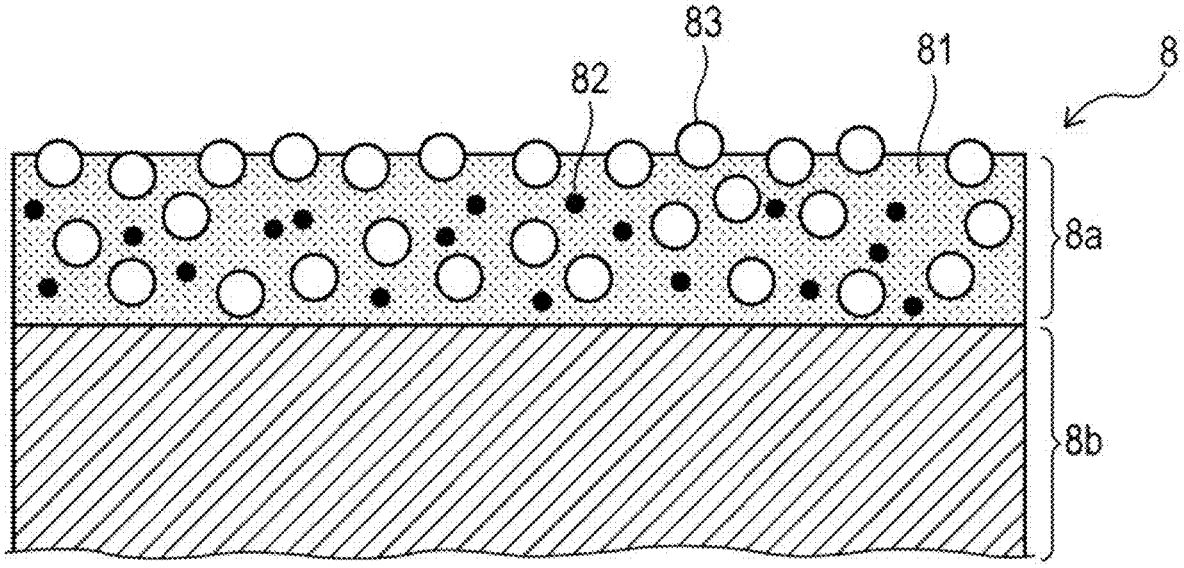
FIG. 3 is a schematic cross-sectional view of an intermediate transfer belt.

Next, the intermediate transfer belt 8 is described. FIG. 3 is a schematic cross-sectional view for illustrating a layer configuration of the intermediate transfer belt 8.

In the first embodiment, the intermediate transfer belt 8 includes a base layer 8*b* and a surface layer 8*a*. In particular, in the first embodiment, the intermediate transfer belt 8 is formed of two layers being the base layer 8*b*, and the surface layer 8*a* which is formed on the base layer 8*b*. The surface layer 8*a* is a layer which is provided on an outer peripheral surface side of the intermediate transfer belt 8 with respect to the base layer 8*b*, and has a surface for carrying (holding) toner transferred from the photosensitive drum 1.

As a material for the base layer 8*b*, there are given, for example, thermoplastic resins such as polycarbonate, polyvinylidene fluoride (PVDF), polyethylene, polypropylene, polymethylpentene-1, polystyrene, polyamide, polysulfone, polyarylate, polyethylene terephthalate, polybutylene terephthalate, polyethylene naphthalate, polybutylene naphthalate, polyphenylene sulfide, polyether sulfone, polyether nitrile, thermoplastic polyimide, polyether ether ketone, a thermotropic liquid crystal polymer, and polyamic acid. Two or more kinds of those materials can be used as a mixture. The base layer 8*b* can be obtained by: melting and kneading a conductive material or the like into any such thermoplastic resin; and then molding the resultant by a molding method appropriately selected from, for example, inflation molding, cylindrical extrusion molding, and injection stretch blow molding.

In the first embodiment, the surface layer 8*a* of the intermediate transfer belt 8 contains acrylic resin 81. More specifically, the surface layer 8*a* of the intermediate transfer belt 8 is formed of acrylic resin as a main component. As the resin which forms the surface layer 8*a*, it is preferred to use the acrylic resin, which is a curable material cured by heat or irradiation of energy rays such as light (for example, ultraviolet ray) or an electron beam and is obtained by curing an acrylic copolymer having an unsaturated double bond. As the unsaturated double bond-containing acrylic copolymer, for example, an acrylic UV-curable resin ("OPSTAR Z7501" (trade name) manufactured by JSR Corporation) can be used. That is, the intermediate transfer belt 8 has the surface layer (cured film) 8*a* obtained by irradiating a liquid containing a UV-curable monomer and/or oligomer component with an energy ray so as to cure the liquid.

In the first embodiment, for adjustment of an electric resistance, a conductive material (conductive filler or electric resistance adjuster) 82 is added to the surface layer 8*a*. As the conductive material 82, an electron conductive material or an ion conductive material can be used. Examples of the electron conductive material include a particulate, fibrous, or flaky carbon-based conductive filler such as carbon black, a PAN-based carbon fiber, or ground expanded graphite. Further, examples of the electron conductive material include a particulate, fibrous, or flaky metal-based conductive filler of silver, nickel, copper, zinc, aluminum, stainless steel, iron, or the like. Further, examples of the electron conductive material include a particulate metal oxide-based conductive filler of zinc antimonate, antimony-doped tin oxide, antimony-doped zinc oxide, tin-doped indium oxide, aluminum-doped zinc oxide, or the like. Examples of the ion conductive material include an ionic liquid, a conductive oligomer, and a quaternary ammonium salt. One or more kinds can be used through appropriate selection from those conductive materials. In addition, the electron conductive material and the ion conductive material may be used as a mixture. Of those, a particulate metal oxide-based conductive filler (particles having a submicron size or smaller, etc.) is preferred from the viewpoint that a small addition amount suffices.

Further, in the first embodiment, for the purpose of improving transfer efficiency and reducing a frictional force with the belt cleaning blade 21, surface layer particles 83 are added to the surface layer 8*a*. The surface layer particles 83 are preferably solid lubricant, and are generally insulating particles. Examples of the surface layer particles 83 include fluorine-containing particles, such as polytetrafluoroethylene (PTFE) resin powder, trifluorochloroethylene resin powder, tetrafluoroethylene-hexafluoropropylene resin powder, vinyl fluoride resin powder, vinylidene fluoride resin powder, difluorodichloroethylene resin powder, and graphite fluoride, and copolymers thereof. One or more kinds can be used through appropriate selection from those particles. Further, the surface layer particles 83 may be solid lubricants, such as silicone resin particles, silica particles, and molybdenum disulfide powder. Of those, polytetrafluoroethylene (PTFE) resin particles (e.g., emulsion polymerization type PTFE resin particles) are preferred because the surface of each of the particles has a low friction coefficient, and the abrasion of another member that is brought into abutment with the surface of the intermediate transfer belt 8, such as the belt cleaning blade 21, can be reduced.

An example of a method of producing the surface layer 8*a* is schematically described as follows. Zinc antimonate particles serving as a conductive material and PTFE particles serving as a solid lubricant are mixed in an unsaturated double bond-containing acrylic copolymer, and the particles are dispersed and mixed by a high-pressure emulsification dispersing machine to produce a coating liquid for forming a surface layer. As a method of forming the surface layer 8*a* on the base layer 8*b* with use of the coating liquid for forming a surface layer, there may be given, for example, general coating methods such as dip coating, spray coating, roll coating, and spin coating. Appropriate selection of those methods can result in the formation of the surface layer 8*a* having a desired thickness.

It is preferred that the intermediate transfer belt 8 obtained as described above have a volume resistivity of from $10^9$ Ω·cm to $10^{12}$ Ω·cm from the viewpoint of satisfactory image formation. The volume resistivity is a value obtained through measurement with a general-purpose measuring device Hiresta UP MCP-HT450 (manufactured by Mitsubishi Chemical Corporation) under an environment of a temperature of 23.5° C. and a relative humidity of 60%.

4. Circumferential Speed Difference Between Photosensitive Drum and Intermediate Transfer Belt In the first embodiment, a speed difference (circumferential speed difference) is provided between the circumferential speed of the photosensitive drum 1 and the circumferential speed of the intermediate transfer belt 8 in order to improve the primary transferability. In the first embodiment, the circumferential speed difference was provided by setting the circumferential speed of the photosensitive drum 1 smaller than the circumferential speed of the intermediate transfer belt 8. However, according to the investigations of the present discloser, it was found that the effect of improving the primary transferability did not change significantly even when the circumferential speed difference was provided by setting the circumferential speed of the intermediate transfer belt 8 smaller than the circumferential speed of the photosensitive drum 1. In order to perform satisfactory primary transfer of a toner image, the circumferential speed difference ({((circumferential speed of intermediate transfer belt)−(circumferential speed of photosensitive drum))/(circumferential speed of intermediate transfer belt)}×100%) is at most 10% or less, preferably 5% or less, and more preferably 3% or less. In the first embodiment, the circumferential speed difference was set to 1.5%, and the circumferential speed of the intermediate transfer belt 8 was set to 210 mm/sec, while the circumferential speed of the photosensitive drum 1 was set to 206.85 mm/sec. In the first embodiment, the circumferential speed of the photosensitive drum 1 was set lower than the circumferential speed of the intermediate transfer belt 8, but the same effect can be obtained even by setting the circumferential speed of the photosensitive drum 1 higher than the circumferential speed of the intermediate transfer belt 8.

5. Measurement of Tackiness

Figure 4:
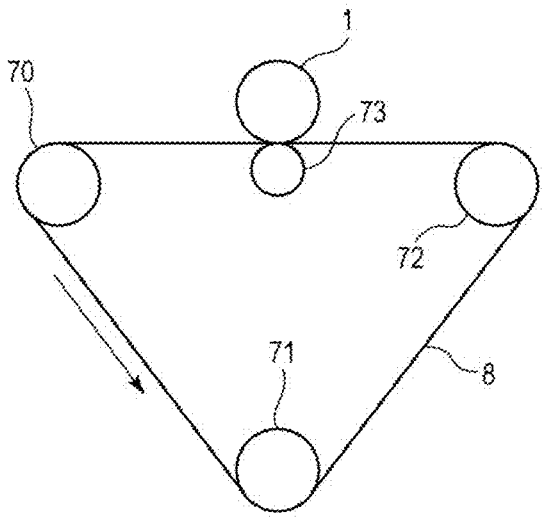
FIG. 4 is an outline cross-sectional view of a device for measuring a surface torque.

Next, measurement of tackiness between the photosensitive drum 1 and the intermediate transfer belt 8 is described. FIG. 4 is an outline cross-sectional view of a device for measuring a surface torque indicating tackiness between the photosensitive drum 1 and the intermediate transfer belt 8.

The photosensitive drum 1 and the intermediate transfer belt 8 are left to stand for 4 hours or more under an environment of a temperature of 23±3° C. and a humidity of 50±5%. As illustrated in FIG. 4, the intermediate transfer belt 8 is triaxially stretched around three rollers of a jig drive roller 70, a jig tension roller 71, and a jig suspension roller 72, at a load of 29.4 N. The jig drive roller 70, the jig tension roller 71, and the jig suspension roller 72 are each set to have an outer diameter of 50 mm. The photosensitive drum 1 is brought into abutment against a backup roller 73 across the intermediate transfer belt 8 at 7.84 N. The backup roller 73 is constructed by forming a rubber layer around a metal core, and has a metal core diameter of 6 mm, a rubber diameter of 14 mm, and a rubber hardness of 20° Asker C. The jig drive roller 70 is driven by a brushless motor (BLM5120HP-GFV) manufactured by Oriental Motor Co., Ltd., through use of a circuit (Oriental Motor Co., Ltd., BMUD120-A2). Then, a torque and a value are read by a digital indicator (F340A) manufactured by Unipulse Corporation.

Specifically, the intermediate transfer belt 8 is uniformly accelerated to 180 mm/sec in 3.37 seconds from the stopped state, and an axial torque value of the jig drive roller 70 is sampled during that period. A cycle period for the sampling is set to 10 msec. A value obtained by averaging sampling data for 2 seconds from rotation start is acquired. The above-mentioned measurement is performed twice, and a value obtained by averaging the acquired values is defined as the surface torque (Nm) indicating the tackiness between the intermediate transfer belt 8 and the photosensitive drum 1. The photosensitive drum 1 is fixedly installed so as not to rotate in such a phase as to have an unused surface brought into abutment against the intermediate transfer belt 8 at the time of measurement.

In the first embodiment, it is preferred that the value of the surface torque be within a range larger than 0.1 N·m and smaller than 0.5 N·m. When the value of the surface torque is 0.1 N·m or less, a level of exposure blur is such a slight level that the exposure blur cannot be visually recognized on the image, and hence it is hardly required to perform an operation for forming a toner image for lubrication in a non-image portion, which is performed in the first embodiment. When the value of the surface torque is 0.5 N·m or more, motors for driving the photosensitive drum 1 and the intermediate transfer belt 8 become larger and more costly, which is not preferred.

6. Toner Image for Lubrication

As described above, when there is a speed difference (circumferential speed difference) between the circumferential speed of the photosensitive drum 1 and the circumferential speed of the intermediate transfer belt 8, a frictional force based on a difference in friction coefficient between the two circumferential speeds is generated. The frictional force changes depending on whether or not toner functioning as a lubricant is present between the photosensitive drum 1 and the intermediate transfer belt 8, and a rotation speed of the photosensitive drum 1 varies. Thus, exposure of the image on the photosensitive drum 1 to light may be blurred to cause a streaky image failure (exposure blur) to occur at a leading edge portion of an image. The exposure blur is liable to occur when there is a sudden change from a state without toner to a state with toner between the photosensitive drum 1 and the intermediate transfer belt 8. That is, the exposure blur is liable to occur when a region on the intermediate transfer belt 8 entering the primary transfer portion N1 changes from the non-image portion to an image portion. Typically, the exposure blur is liable to occur when the region on the intermediate transfer belt 8 entering the primary transfer portion N1 changes from a non-image region, which is located on a downstream side (leading edge side) of an image region set for each transfer material S in terms of a movement direction of a surface of the intermediate transfer belt 8, to the image region.

In view of this, in the first embodiment, the control portion 80 is configured to be capable of performing control as follows. That is, the control portion 80 performs control to form a toner image for a print image, which is to be secondarily transferred to the transfer material S, in the image portion on the intermediate transfer belt 8, based on the image information. At the same time, the control portion 80 performs control to form a toner image for lubrication in the non-image portion on the intermediate transfer belt 8 in which the toner image for the print image is not to be formed, the non-image portion being located on downstream of the image portion in which the toner image for the print image is to be formed in terms of the movement direction of the surface of the intermediate transfer belt 8. That is, in the first embodiment, the control portion 80 forms, on the intermediate transfer belt 8, the toner image for lubrication serving as a predetermined toner image caused to function as a lubricant by being interposed between the photosensitive drum 1 and the intermediate transfer belt 8 before the toner image for the print image is formed on the intermediate transfer belt 8.

The "toner image for the print image" refers to a toner image formed on the transfer material S to form a printed product to be output from the image forming apparatus 100 in response to an instruction received from an external apparatus, for example, a personal computer. The "toner image for lubrication" may be formed by the same image forming process as in the case of the "toner image for the print image," but is not expected to be formed on the transfer material S to form a printed product to be output from the image forming apparatus 100. The "toner image for lubrication" may have a part or an entirety thereof transferred to the transfer material S and output from the image forming apparatus 100 together with the "toner image for the print image" as described later, but is not desired to be visually recognized (is desired to avoid being visually recognized). In regard to an arrangement of a toner image formed on the intermediate transfer belt 8 or an arrangement of the image forming portions P, the phrases "upstream," "downstream," "leading edge," and "trailing edge" hereinafter refer to locations in terms of the movement direction of the surface of the intermediate transfer belt 8 unless explicitly specified. The "toner image for the print image" may also be hereinafter referred to simply as "print image." The "toner image for lubrication" may also be hereinafter referred to simply as "lubricating image."

Figure 15A:
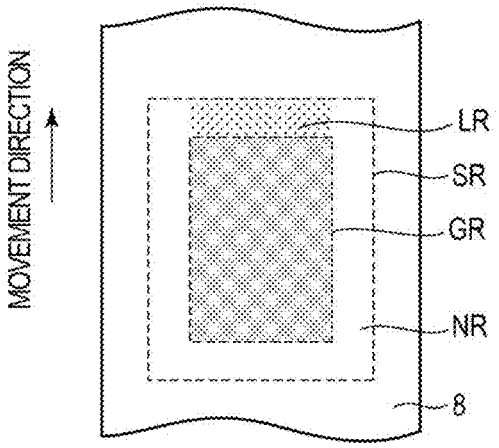
FIG. 15A, FIG. 15B, and FIG. 15C are schematic views for illustrating formation modes of the toner image for lubrication.

In general, as illustrated in FIG. 15A, a transfer material region SR, an image region GR, and a non-image region NR, each having a predetermined width in a main scanning direction and a sub-scanning direction, are set on the intermediate transfer belt 8 for each print image to be formed on one transfer material S. In this case, the "main scanning direction" refers to a direction intersecting the movement direction of the surface of the intermediate transfer belt 8 (or the photosensitive drum 1) (substantially perpendicularly in the first embodiment), and corresponds to a direction for scanning a laser beam of the exposure device 3. Meanwhile, the "sub-scanning direction" refers to the movement direction of the surface of the intermediate transfer belt 8 (or the photosensitive drum 1), and corresponds to a direction substantially perpendicular to the main scanning direction. The "transfer material region SR" refers to a region on the intermediate transfer belt 8 (or a region on the corresponding photosensitive drum 1) to be brought into contact with the transfer material S at the secondary transfer portion N2. The "image region GR" refers to a region on the intermediate transfer belt 8 (or a region on the corresponding photosensitive drum 1) on which a print image can be formed. The "non-image region NR" refers to a region on which a print image is not to be formed, the region being typically provided outside the image region and inside the transfer material region on both-end-portion sides of the image region in terms of the main scanning direction and on both-end-portion sides of the image region in terms of the sub-scanning direction. Specifically, the control portion 80 sets the transfer material region SR, the image region GR, and the non-image region NR by, for example, outputting a signal indicating an image write start timing (and an image write end timing) in the main scanning direction and a signal indicating an image write start timing (and an image write end timing) in the sub-scanning direction to the exposure device 3 or another destination depending on the size of the transfer material S for each print image to be formed on one transfer material S.

Figure 15B:
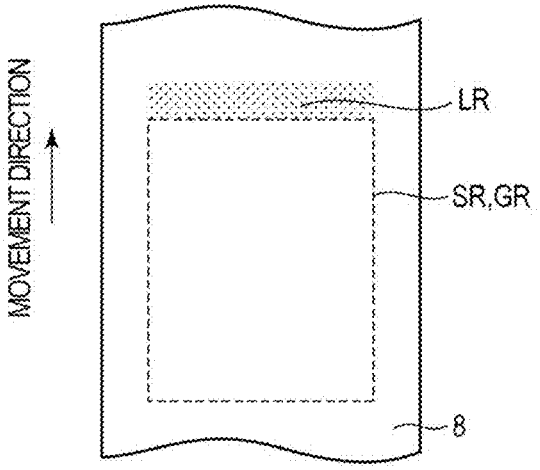
Figure 15C:
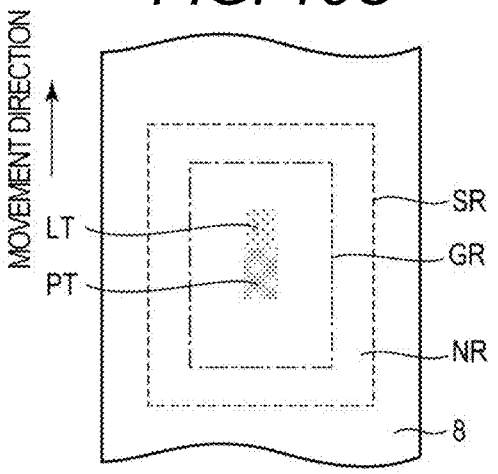

In this case, as illustrated in FIG. 15A, the control portion 80 typically performs control to form a lubricating image in the non-image region NR (region LR of FIG. 15A) inside the transfer material region SR and on the downstream side (leading edge side) of the image region GR. However, the present disclosure is not limited thereto. For example, as illustrated in FIG. 15B, when the transfer material region SR and the image region GR are substantially the same (so-called borderless printing), the control portion 80 can perform control as follows. That is, the control can be performed so as to form a lubricating image in an adjacent region (region LR of FIG. 15B) on the intermediate transfer belt 8 on the downstream side (leading edge side) of the image region GR and the transfer material region SR. In this case, as described later, the lubricating image may be adjacent to the print image without a gap, or may be adjacent to the print image with a gap. The same applies to a case in which there is no non-image region (margin) at least on the leading edge side. In another case, for example, as illustrated in FIG. 15C, the control portion 80 may perform control to form a lubricating image LT in a region on the intermediate transfer belt 8 adjacent to a print image PT on the downstream side (leading edge side) of the print image PT inside the image region GR. The lubricating image LT may be formed across the image region and the non-image region. In this case as well, as described later, the lubricating image may be adjacent to the print image without a gap, or may be adjacent to the print image with a gap.

That is, in the first embodiment, the control portion 80 outputs a signal for forming a lubricating image before outputting a signal for forming a print image so that the lubricating image is primarily transferred onto the intermediate transfer belt 8 before the print image is primarily transferred onto the intermediate transfer belt 8.

The lubricating image can be prevented from being transferred to the transfer material S by, for example, adjusting an application timing of the secondary transfer bias with respect to the secondary transfer roller 11. For example, when the lubricating image is formed outside the image region as illustrated in FIG. 15A and FIG. 15B, the lubricating image can be prevented from being transferred to the transfer material S in the above-mentioned manner. However, as described later, for example, when the lubricating image is formed with yellow toner being difficult to be visually recognized, a part or entirety of the lubricating image may be transferred to the transfer material S. For example, the lubricating image may be transferred to the transfer material S not only when the lubricating image is formed inside the image region as illustrated in FIG. 15C but also when the lubricating image is formed outside the image region as illustrated in FIG. 15A.

The description is further given by taking an exemplary case of forming the lubricating image in the non-image region on the downstream side (leading edge side) of the image region as illustrated in, for example, FIG. 15A. As described above, in the first embodiment, the lubricating image is formed on the intermediate transfer belt 8 in advance before the print image formed on the photosensitive drum 1 is primarily transferred onto the intermediate transfer belt 8. Thus, toner is present between the intermediate transfer belt 8 and the photosensitive drum 1 from a time point at which the transfer material region enters the primary transfer portion N1. The presence of toner can suppress a sudden change from the state without toner to the state with toner when the image region enters the primary transfer portion N1. This can alleviate variations in rotation speed of the photosensitive drum 1. As a result, stable image formation can be performed, and a print image having high image quality can be obtained.

In this case, the lubricating image is formed before the print image is formed. Thus, when the image forming apparatus 100 includes a plurality of image forming portions P, it is preferred that the lubricating image be formed by the image forming portion P most upstream, which is to form a toner image first. In addition, the lubricating image is not a print image to be output by being transferred to the transfer material S, and hence it is preferred to form the lubricating image with yellow toner being more difficult to be visually observed. That is, when the image forming apparatus 100 includes a plurality of image forming portions P configured to form toner images of mutually different colors, it is preferred that the lubricating image be formed by the image forming portion PY configured to form a toner image with yellow toner. However, for example, when a lubricating image is formed in the non-image region as illustrated in FIG. 15A and the lubricating image is controlled so as not to be transferred to the transfer material S, the lubricating image may be formed with toner of any color. Toners of a plurality of colors may also be used to form the lubricating image by being superimposed on each other or without being superimposed on each other.

The lubricating image can be formed on the downstream side (leading edge side) of the print image so as to be adjacent to the print image without a gap. However, the present disclosure is not limited thereto. The present disclosure may be applied to, for example, a case in which the lubricating image is formed in the non-image region on the downstream side (leading edge side) of the image region as illustrated in FIG. 15A and there is a gap between the non-image region and the image portion inside the image region in which the print image is to be actually formed. The present disclosure may also be applied to, for example, a case in which, as described later, the print image and the lubricating image are formed at different positions in terms of the main scanning direction when a toner amount of the lubricating image is adjusted based on the image information on the print image. It can be said to be desired to form the lubricating image in close contact with the print image as described above in order to reduce the above-mentioned variations in frictional force. However, typically, it suffices that the lubricating image is present on the intermediate transfer belt 8 on the downstream side (leading edge side) of the print image, for example, inside the non-image region in the transfer material region illustrated in FIG. 15A. This can reduce the above-mentioned variations in frictional force due to the presence of toner between the intermediate transfer belt 8 and the photosensitive drum 1 before the print image is primarily transferred onto the intermediate transfer belt 8. More specifically, it is preferred that at least a part of the lubricating image be present within a range of a distance corresponding to a distance from an exposure position to a primary transfer position in terms of a rotation direction of the photosensitive drum 1 on the downstream side (leading edge side) of a downstream-side edge portion (leading edge) of the print image. This is because at least a part of the exposure blur due to the above-mentioned variations in frictional force can be reduced by causing at least a part of the lubricating image to be present at the primary transfer portion N1 after the start of the exposure of the print image to light until the primary transfer of the print image. For example, when the lubricating image is to be formed in the non-image region on the downstream side (leading edge side) of the image region as illustrated in FIG. 15A, the lubricating image can be formed so as to be continuous over an entire range of the non-image region in terms of the sub-scanning direction. When the lubricating image is to be formed outside the transfer material region as illustrated in FIG. 15B or the lubricating image is to be formed inside the image region as illustrated in FIG. 15C, the following can be performed. That is, the lubricating image can be formed so as to be continuous in the sub-scanning direction over a range equal to or more than the above-mentioned range of the distance corresponding to the distance from the exposure position to the primary transfer position in terms of the rotation direction of the photosensitive drum 1 on the downstream side (leading edge side) of the downstream-side edge portion (leading edge) of the print image.

In the first embodiment, a pattern in which toner images (hereinafter also referred to as "minute dots") each having a minute area in units of one or more dots are dispersed in the main scanning direction and the sub-scanning direction is formed as the lubricating image. As a method of forming the pattern of minute dots, it is possible to employ such a method as described in Japanese Patent Application Laid-Open No. 2004-118076, but the present disclosure is not limited thereto. That is, an image region is divided into dot regions each being formed of "m" dots in the main scanning direction and "n" dots in the sub-scanning direction, and an operation of forming a toner image in one or more dots in each of the dot regions is repeated, to thereby be able to form the pattern of minute dots.

7. Toner Amount of Toner Image for Lubrication

Next, a method of changing a toner amount of the toner image for lubrication (lubricating image) to be formed in the non-image portion based on the image information is described.

As described above, in technologies for forming a lubricating image which have been proposed hitherto, the lubricating image is formed at a predetermined coverage rate over the entire width of the image region in terms of the main scanning direction. This has raised a problem in that a consumption amount of the toner used for forming the lubricating image increases. For example, when a lubricating image is formed with a toner of a predetermined color among toners of a plurality of colors, there has been a problem in that the consumption amount of the toner of the color used for forming the lubricating image increases.

Figure 5A:
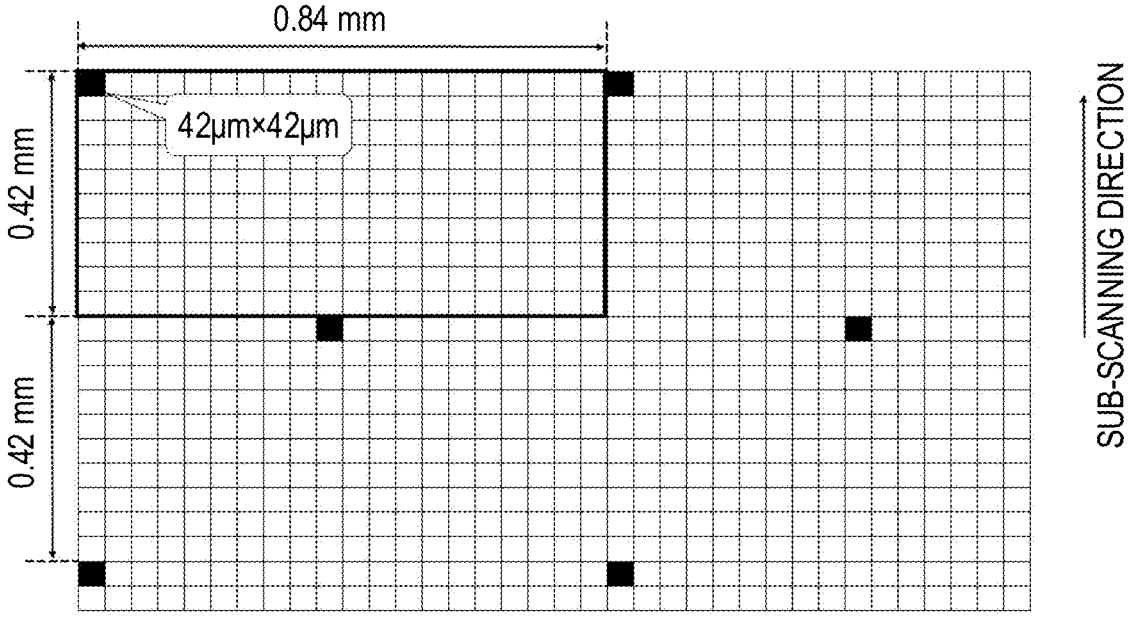
FIG. 5A and FIG. 5B are schematic views of an embodiment of a toner image for lubrication (pattern of minute dots).

In the first embodiment, as an example of the lubricating image, the pattern of minute dots is formed with the yellow toner. FIG. 5A is an illustration of an example of the pattern of minute dots serving as the lubricating image in the first embodiment. One cell of FIG. 5A represents one pixel (42 μm×42 μm), and a pixel indicated as a black cell in FIG. 5A is set to have data of FFh, to thereby form the minute dot at this position. In the image forming apparatus 100 according to the first embodiment, the image data has 256 levels of gray of from 00h to FFh, and FFh corresponds to full light emission of the laser. The pattern of minute dots illustrated in FIG. 5A is obtained by arranging minute dots having the same size at an oblique angle of 45° with respect to the main scanning direction, and has a dot spacing of 0.84 mm in the main scanning direction and a dot spacing of 0.42 mm in the sub-scanning direction. The image data of this pattern of minute dots has a coverage rate of 0.5%. In this case, the "coverage rate" refers to, assuming that a total sum of image data obtained when the image data of every pixel in a unit area is FFh is set as 100%, a ratio (image ratio) of the total sum of image data of the pixels in the unit area. The coverage rate correlates to the toner amount per unit area of the toner image. An image having a coverage rate of 100% is hereinafter referred to also as "solid image." A halftone image can include an image having a coverage rate of more than 0% and less than 100%, but is typically an image having a coverage rate of from about 30% to about 80%.

Figure 6:
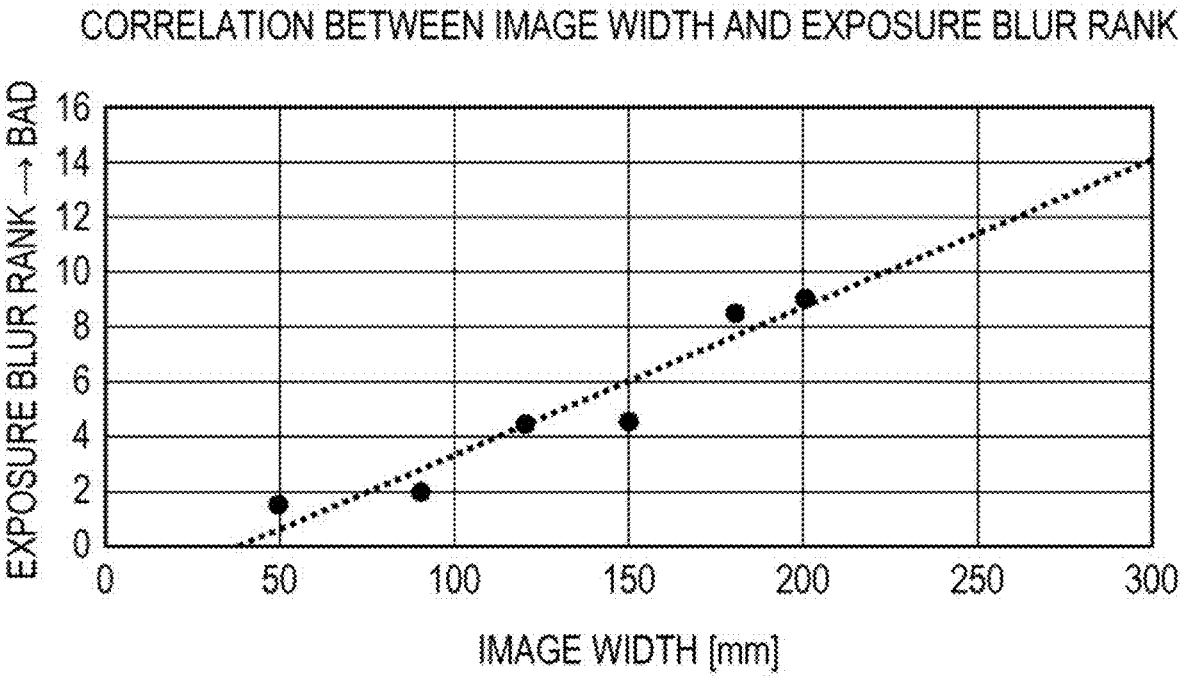
FIG. 6 is a graph for showing a correlation between a width of a print image and a level of exposure blur.

FIG. 6 is a graph for showing an example of a result of examining a correlation between a width of the print image in terms of the main scanning direction and a rank of the exposure blur. The exposure blur was examined through visual observation and ranked from "0" indicating the most satisfactory state to "16" indicating the least satisfactory state. As print images for evaluation, images having widths ranging from 50 mm to 200 mm in terms of the main scanning direction were formed in a central portion of the image region in terms of the main scanning direction. The print images for evaluation were each formed as a halftone image having an image data coverage rate of 50%, which is a rectangular image having two sides substantially parallel to the main scanning direction and two sides substantially parallel to the sub-scanning direction. As shown in FIG. 6, according to the investigations of the present discloser, it was found that the level of exposure blur improved when the width of the print image in terms of the main scanning direction became smaller.

Figure 14:
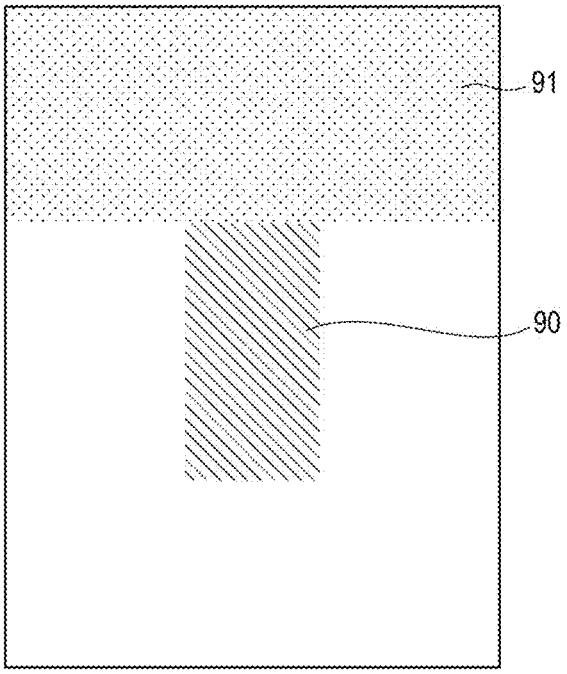
FIG. 14 is a schematic view for illustrating a toner image for lubrication in Comparative Example 1.

Thus, when the width of the print image in terms of the main scanning direction is small, a width of the lubricating image in terms of the main scanning direction is not required to be set to the entire width of the image region in terms of the main scanning direction. That is, for example, when a width of a print image 90 (halftone image having the image data coverage rate of 50%) in terms of the main scanning direction is small as in Comparative Example 1 illustrated in FIG. 14, a width of a lubricating image 91 in terms of the main scanning direction is not required to be set to the entire width of the image region in terms of the main scanning direction.

In view of this, in the first embodiment, the control portion 80 performs control to change the toner amount of the lubricating image to be formed in the non-image portion based on the image information on the print image. In particular, in the first embodiment, the control portion 80 performs control to change the size of a region for forming the lubricating image based on the image information on the print image. That is, the control portion 80 performs control so that the width of the lubricating image in terms of the main scanning direction becomes smaller when the width of the print image in terms of the main scanning direction is a second width, which is smaller than a first width, than when the width of the print image is the first width.

In this case, it is assumed that the width of the print image in terms of the main scanning direction is represented by a distance between both ends of the print image in terms of the main scanning direction at the edge portion of the print image on the downstream side (leading edge side). When the print image is, for example, such a continuous region as the above-mentioned rectangular halftone image, the above-mentioned distance between both ends may be a distance between both ends of the continuous region in terms of the main scanning direction. When the print image is formed of a plurality of isolated images (for example, a text image), the above-mentioned distance between both ends may be a distance between both ends of a region including the plurality of images in terms of the main scanning direction. In another case, the above-mentioned distance between both ends may be a distance between both ends of each image of the plurality of images in terms of the main scanning direction. The "region of the lubricating image (toner image for lubrication)" refers to a region between both ends in terms of each of the main scanning direction and the sub-scanning direction. For example, when the lubricating image is formed as the pattern of minute dots as in the first embodiment, the "region of the lubricating image" refers to a range surrounded by two straight lines along the sub-scanning direction passing through the respective outermost minute dots at both end portions in the main scanning direction and two straight lines along the main direction passing through the respective outermost minute dots at both end portions in the sub-scanning direction. In the first embodiment, it is assumed that the region of the lubricating image is a rectangular region having two sides substantially parallel to the main scanning direction and two sides substantially parallel to the sub-scanning direction. It is also assumed that lubricating images of specific examples described in the first embodiment and an embodiment described later are each formed in the non-image region on the downstream side (leading edge side) of the image region as illustrated in FIG. 15A, and that the print image is formed so as to be adjacent to a boundary between the non-image region and the image region with almost no gap. In this case, a region for forming the lubricating image (toner image for lubrication), for example, a region for forming the pattern of minute dots, is also referred to simply as "lubricating image."

Figure 7:
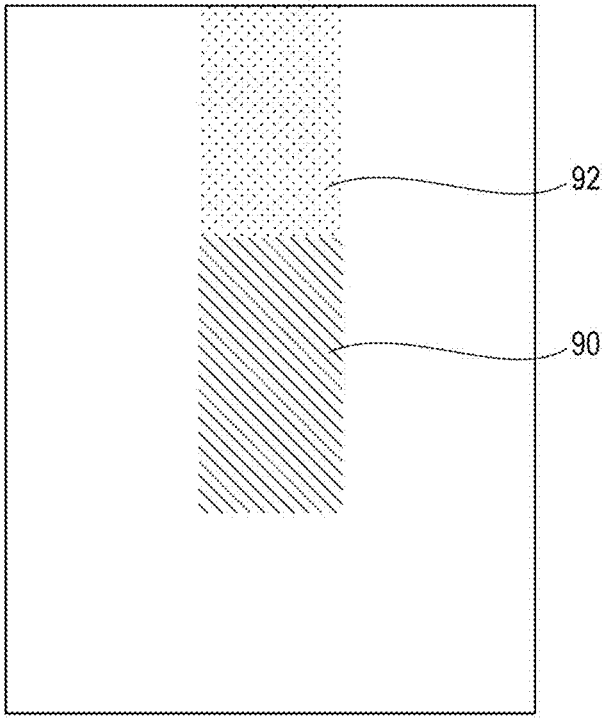
FIG. 7 is a schematic view for illustrating an embodiment of the toner image for lubrication.

FIG. 7 is a schematic view of an example of the lubricating image formed in accordance with the first embodiment. In the example illustrated in FIG. 7, the width of the print image 90 (halftone image having the image data coverage rate of 50%) in terms of the main scanning direction is smaller than the width of the image region in terms of the main scanning direction. In the first embodiment, in this case, the control portion 80 sets the width of the lubricating image 92 to match the width of the print image 90 so that the width of the lubricating image 92 becomes the same as the width of the print image 90 in terms of the main scanning direction.

Figure 8:
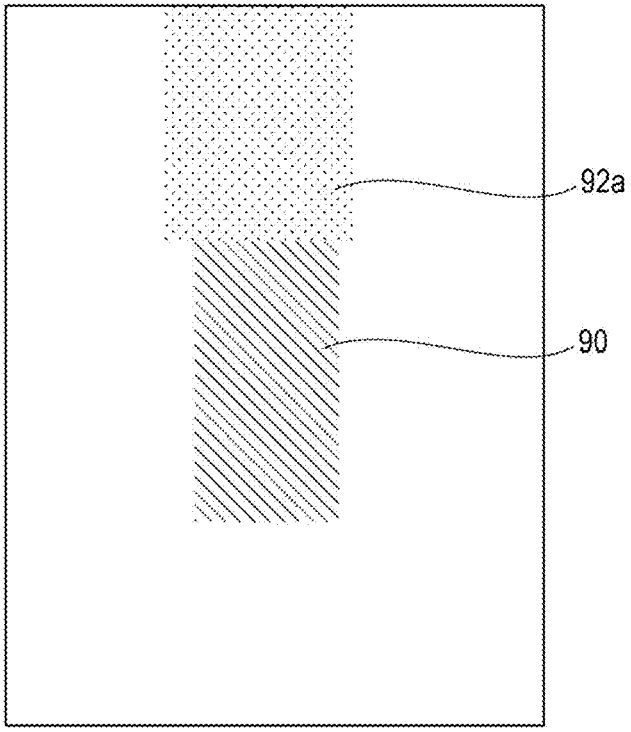
FIG. 8 is a schematic view for illustrating another embodiment of the toner image for lubrication.
Figure 9:
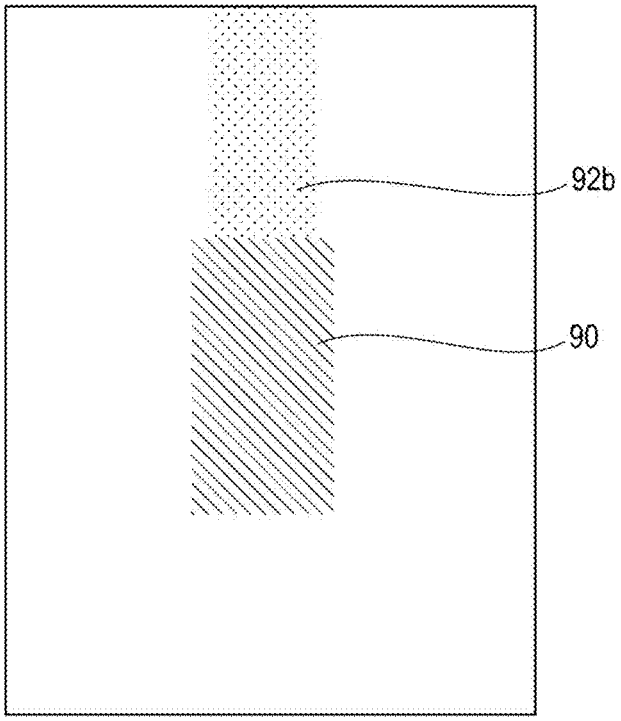
FIG. 9 is a schematic view for illustrating another embodiment of the toner image for lubrication.

In the example illustrated in FIG. 7, the width of the lubricating image 92 is set to be the same as the width of the print image 90 in terms of the main scanning direction, but the widths are not always required to be exactly the same. For example, as illustrated in FIG. 8, a width of a lubricating image 92*a* may be set larger than the width of the print image 90 in terms of the main scanning direction. Meanwhile, for example, as illustrated in FIG. 9, a width of a lubricating image 92*b* may be set smaller than the width of the print image 90 in terms of the main scanning direction. It suffices to adjust the width to an optimum width so as to be able to suppress the exposure blur depending on, for example, the configuration of the image forming apparatus 100.

Figure 10:
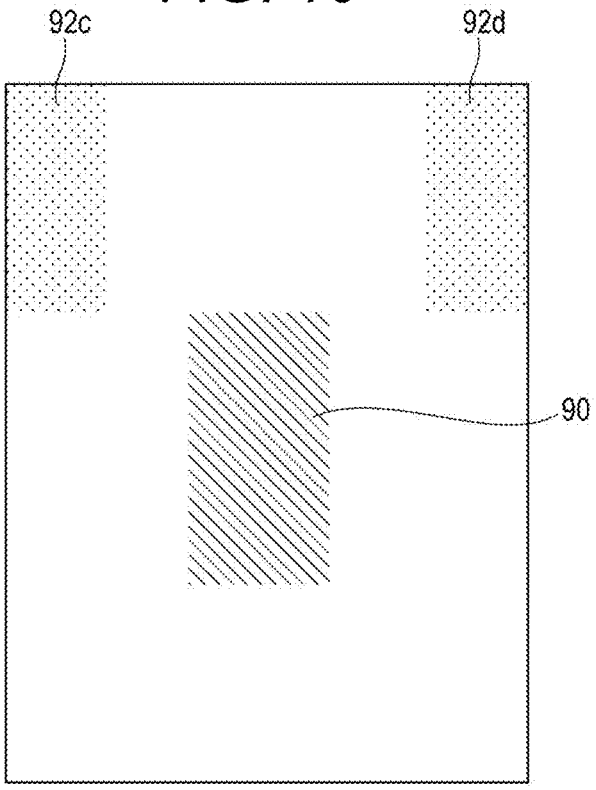
FIG. 10 is a schematic view for illustrating another embodiment of the toner image for lubrication.

As illustrated in FIG. 7 to FIG. 9, the control portion 80 can perform control to form the lubricating image so that at least a part of the lubricating image and at least a part of the print image overlap each other in terms of the main scanning direction. However, the present disclosure is not limited thereto. For example, as illustrated in FIG. 10, the position of the print image 90 and positions of lubricating images 92*c* and 92*d* may be separated from each other in terms of the main scanning direction. In the example of FIG. 10, two divided lubricating images are formed at positions different from the position of the print image in terms of the main scanning direction. That is, the control portion 80 can perform control to form the lubricating image so as to avoid an overlap between the lubricating image and the print image in terms of the main scanning direction. However, in this case, a boundary region between the lubricating image and the non-image portion increases, and hence the lubricating image can be liable to be more easily visually recognized. Thus, as illustrated in FIG. 7 to FIG. 9, it is preferred to form the lubricating image near the print image (at a position at which at least a part of the lubricating image and at least a part of the print image overlap each other in terms of the main scanning direction). As illustrated in FIG. 10, when the lubricating image is formed of a plurality of divided portions, the total width of the widths of the respective portions is set based on the width of the print image (which may be the width of the total of the respective portions when the print image is formed of a plurality of isolated portions).

As described above, in the first embodiment, the toner amount of the lubricating image to be formed in the non-image portion is changed based on the image information on the print image. Accordingly, it is possible to suppress an occurrence of the exposure blur while suppressing the consumption amount of the toner used for forming the lubricating image.

Second Embodiment

Next, another embodiment of the present disclosure is described. Basic configuration and operation of an image forming apparatus according to a second embodiment of the present disclosure are the same as those of the first embodiment. Therefore, elements of the image forming apparatus according to the second embodiment that have the same or corresponding functions or configurations as those of the image forming apparatus according to the first embodiment are denoted by the same reference symbols as those of the first embodiment, and detailed description thereof is omitted herein.

In the second embodiment, the coverage rate of the lubricating image is changed based on the image information on the print image.

The exposure blur tends to be difficult to be visually recognized on the image when a density of the print image is high. This can cause the coverage rate of the image data of a minute dot pattern serving as the lubricating image to become lower when the density of the print image is relatively high than when the density of the print image is relatively low. In view of this, in the second embodiment, the control portion 80 performs control so that the coverage rate of the lubricating image becomes lower when the density of the print image is a second density, which is higher than a first density, than when the density of the print image is the first density. Typically, in the second embodiment, the control portion 80 performs control so that the coverage rate of the lubricating image is smaller when the print image is a solid image than when the print image is a halftone image. The density of the print image can be expressed by an amount of toner per unit area ($mg/cm^2$) in the image or the coverage rate. When the density is relatively high, the amount of toner per unit area and the coverage rate are both higher than when the density is relatively low.

Figure 11:
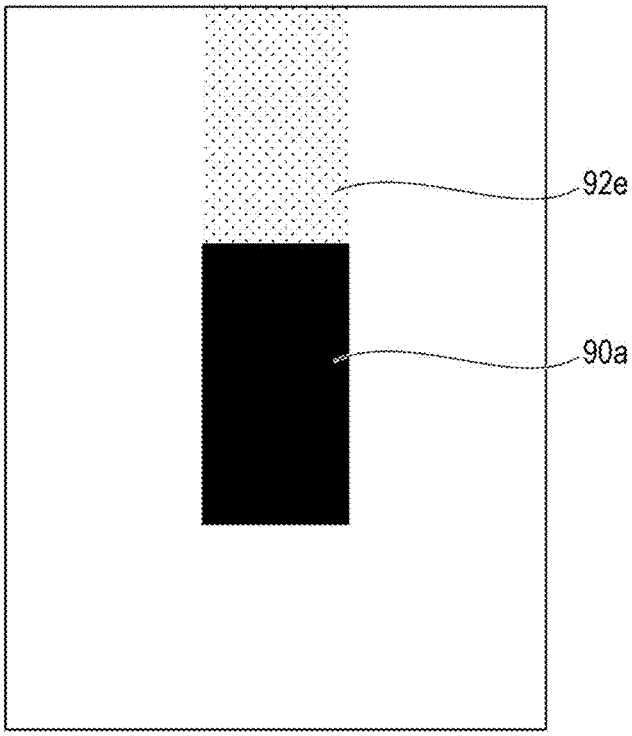
FIG. 11 is a schematic view for illustrating another embodiment of the toner image for lubrication.

FIG. 11 is a schematic view of an example of the lubricating image formed in accordance with the second embodiment. A print image 90*a* illustrated in FIG. 11 is a so-called solid image having an image data coverage rate of 100%. In this case, the exposure blur is less noticeable than in the case of the print image 90 being the halftone image having the image data coverage rate of 50% in the example described in the first embodiment with reference to FIG. 7. Thus, in this case, the occurrence of the exposure blur can be suppressed even when the coverage rate of the image data of the pattern of minute dots serving as a lubricating image 92*e* is set to 0.25%, which is half of 0.5% in the first embodiment.

The exposure blur also tends to be more difficult to be visually recognized on the image when the print image is a text image than when the print image is a halftone image. In view of this, in the second embodiment, the control portion 80 performs control so that the coverage rate of the lubricating image becomes smaller when the print image is a text image than when the print image is a halftone image.

Figure 12:
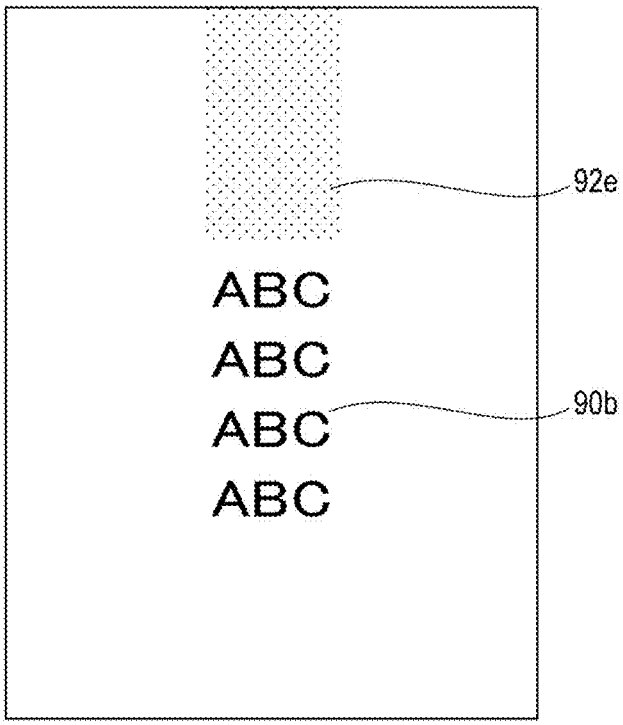
FIG. 12 is a schematic view for illustrating another embodiment of the toner image for lubrication.

FIG. 12 is a schematic view of another example of the lubricating image formed in accordance with the second embodiment. A print image 90*b* illustrated in FIG. 12 is text data. In this case, the exposure blur is less noticeable than in the case of the print image 90 being the halftone image in the example described in the first embodiment with reference to FIG. 7. Thus, in this case, the occurrence of the exposure blur can be suppressed even when the coverage rate of the image data of the pattern of minute dots serving as the lubricating image 92*e* is set to 0.25%, which is half of 0.5% in the first embodiment. As a character size of text becomes smaller, the exposure blur becomes less noticeable, and hence the coverage rate of the lubricating image can be further reduced.

As described above, in the second embodiment, the coverage rate of the lubricating image to be formed in the non-image portion is changed based on the image information. Accordingly, it is possible to suppress an occurrence of the exposure blur while further suppressing the consumption amount of the toner used for forming the lubricating image.

From the viewpoint of reducing the consumption amount of the toner used for forming the lubricating image as in the second embodiment, it is preferred to change the size of the lubricating image and the coverage rate based on the image information on the print image, but it is also possible to change only the coverage rate.

Third Embodiment

Next, another embodiment of the present disclosure is described. Basic configuration and operation of an image forming apparatus according to a third embodiment of the present disclosure are the same as those of the first embodiment. Therefore, elements of the image forming apparatus according to the third embodiment that have the same or corresponding functions or configurations as those of the image forming apparatus according to the first embodiment are denoted by the same reference symbols as those of the first embodiment, and detailed description thereof is omitted herein.

In the third embodiment, the coverage rate of the lubricating image in the lubricating image region is changed based on the image information on the print image.

In the first embodiment, for example, as illustrated in FIG. 9, the width of the lubricating image is reduced based on the width of the print image. In this case, boundaries between the lubricating image and the non-image portions (solid white portions) on both end sides of the lubricating image in terms of the main scanning direction can become noticeable depending on conditions. In view of this, in the third embodiment, the control portion 80 performs control as to change the coverage rate of the lubricating image in the region for forming the lubricating image based on the image information on the print image. More specifically, the control portion 80 sets the width of the lubricating image in terms of the main scanning direction based on the width of the print image in terms of the main scanning direction, and also performs control so that a coverage rate of a second portion of the lubricating image on an edge portion side in terms of the main scanning direction becomes smaller than a coverage rate of a first portion of the lubricating image in the central portion in terms of the main scanning direction.

Figure 13:
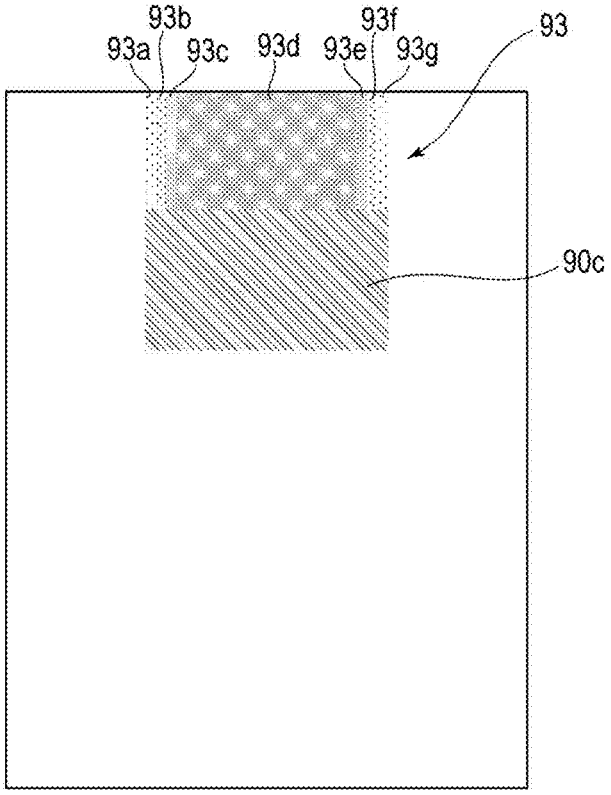
FIG. 13 is a schematic view for illustrating another embodiment of the toner image for lubrication.

FIG. 13 is a schematic view of an example of the lubricating image formed in accordance with the third embodiment. In this example, the width of the lubricating image 93 is set (the same as a width of a print image 90*c* (halftone image having the image data coverage rate of 50%)) so as to match the width of the print image 90*c* in terms of the main scanning direction, and the coverage rate of the lubricating image is changed in the region of the lubricating image 93. Specifically, a central first portion 93*d* of the lubricating image 93 in terms of the main scanning direction is set to have a coverage rate of 0.5%. Meanwhile, second portions 93*c* and 93*e* adjacent to both sides of the first portion 93*d* in terms of the main scanning direction are set to have a coverage rate of 0.4%. In addition, third portions 93*b* and 93*f* adjacent to outer sides of the second portions 93*c* and 93*e* in terms of the main scanning direction are set to have a coverage rate of 0.3%. Further, fourth portions (outermost peripheries) 93*a* and 93*g* adjacent to outer sides of the third portions 93*b* and 93*f* in terms of the main scanning direction are set to have a coverage rate of 0.2%. In this manner, in the example of FIG. 13, a gradient is provided to the coverage rate of the lubricating image so that a density of the lubricating image decreases from the inner side toward the both end portions of the region of the lubricating image in terms of the main scanning direction. This causes the boundary between the region of the lubricating image and the region of the solid white portion to become less noticeable. In this manner, the configuration of the third embodiment can be said to be a more preferred configuration from the viewpoint that the lubricating image becomes more difficult to be visually recognized.

As described above, in the third embodiment, the coverage rate of the lubricating image is changed inside the region of the lubricating image based on the image information. Accordingly, it is possible to suppress the occurrence of the exposure blur while suppressing the consumption amount of the toner used for forming the lubricating image and while causing the boundary between the region of the lubricating image and the region of the solid white portion to become less noticeable.

Fourth Embodiment

Next, another embodiment of the present disclosure is described. Basic configuration and operation of an image forming apparatus according to a fourth embodiment of the present disclosure are the same as those of the first embodiment. Therefore, elements of the image forming apparatus according to the fourth embodiment that have the same or corresponding functions or configurations as those of the image forming apparatus according to the first embodiment are denoted by the same reference symbols as those of the first embodiment, and detailed description thereof is omitted herein.

In the fourth embodiment, a toner amount on a trailing edge side of the lubricating image in the sub-scanning direction is controlled to become larger than a toner amount on a leading edge side of the lubricating image in the sub-scanning direction.

<Toner Amount of Toner Image for Lubrication on Leading Edge Side>

Figure 16A:
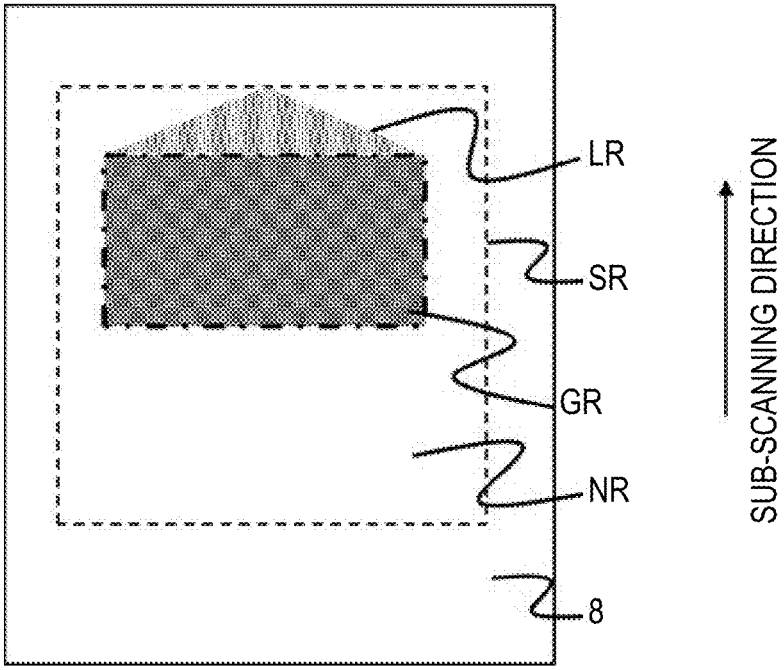
FIG. 16A, FIG. 16B, and FIG. 16C are schematic views for illustrating embodiments of a lubricating image.
Figure 16B:
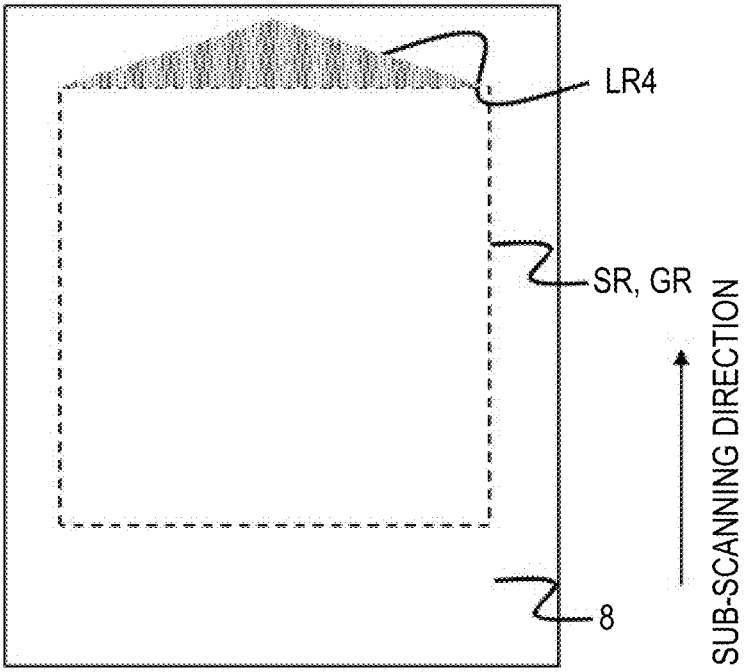

Next, a leading-edge-side toner amount of the lubricating image to be formed in the non-image portion in the sub-scanning direction, which is a feature of the present disclosure, is described. As described above, in the technologies for forming a lubricating image which have been proposed hitherto, the lubricating image is formed at a predetermined coverage rate over the entire width of the image region in terms of the main scanning direction. Thus, as described above, a sudden change in frictional force from the state without toner to the state with toner may cause the exposure blur ascribable to the lubricating image. When the length of the lubricating image in the sub-scanning direction can be set longer than the "distance corresponding to the distance from the exposure position to the primary transfer position in terms of the rotation direction of the photosensitive drum 1," the above-mentioned exposure blur ascribable to the lubricating image becomes less noticeable. However, it is not preferred to cause the length of the lubricating image to become longer than required in consideration of the recent decrease in size of apparatus and from the viewpoint of minimizing a time period after a print job is transmitted until the printing of the first sheet is started. In the fourth embodiment, as illustrated in FIG. 16A, the control portion 80 forms a lubricating image LR so as to have a larger toner amount on the trailing edge side in the sub-scanning direction than the toner amount on the leading edge side. Through the forming of such a lubricating image LR as illustrated in FIG. 16A, it is possible to suppress the above-mentioned sudden change in frictional force and suppress the exposure blur ascribable to the lubricating image. FIG. 16B is a view for illustrating a lubricating image LR4 in an embodiment at the time of borderless printing described above.

In the fourth embodiment, as an example of the lubricating image, the pattern of minute dots is formed with the yellow toner. FIG. 5A is an illustration of an example of the pattern of minute dots serving as the lubricating image in the fourth embodiment. One cell of FIG. 5A represents one pixel (42 μm×42 μm), and a pixel indicated as a black cell in FIG. 5A is set to have data of FFh, to thereby form the minute dot at this position. In the image forming apparatus 100 according to the fourth embodiment, the image data has 256 levels of gray of from 00h to FFh, and FFh corresponds to full light emission of the laser. The pattern of minute dots illustrated in FIG. 5A is obtained by arranging minute dots having the same size at an oblique angle of 45° with respect to the main scanning direction, and has a dot spacing of 0.84 mm in the main scanning direction and a dot spacing of 0.42 mm in the sub-scanning direction. The image data of this pattern of minute dots has a coverage rate of 0.5%. In this case, the "coverage rate" refers to, assuming that a total sum of image data obtained when the image data of every pixel in a unit area is FFh is set as 100%, a ratio (image ratio) of the total sum of image data of the pixels in the unit area. The coverage rate correlates to the toner amount per unit area of the toner image. An image having a coverage rate of 100% is hereinafter referred to also as "solid image." A halftone image can include an image having a coverage rate of more than 0% and less than 100%, but is typically an image having a coverage rate of from about 30% to about 80%. As a guide for a necessary minimum toner amount required for obtaining the above-mentioned frictional force reducing effect, at least a part of the lubricating image formed of minute dots having a coverage rate of 0.5% in the sub-scanning direction is preferred to be present over the entire width of the image region GR in the main scanning direction.

Figure 5B:
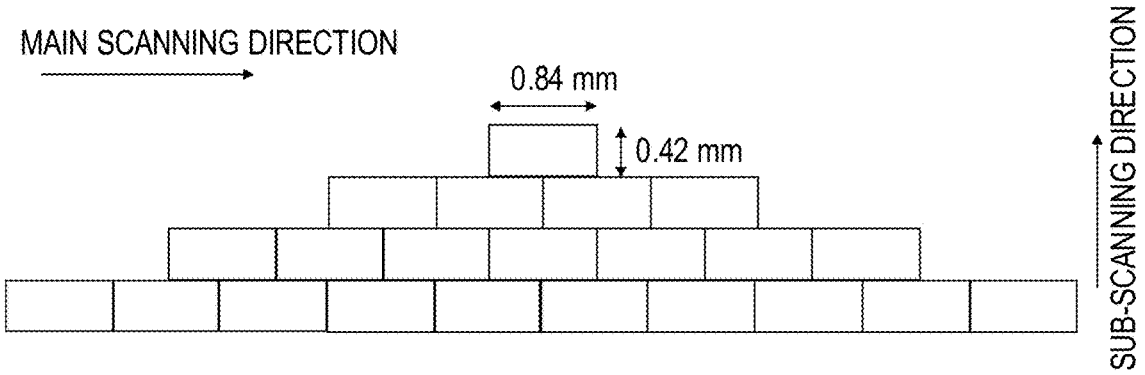

FIG. 5B is an illustration of an example of a more detailed arrangement of a minute dot pattern formed of unit cells each having "a dot spacing of 0.84 mm in the main scanning direction and dot spacing of 0.42 mm in the sub-scanning direction" described above. Such a lubricating image LR as illustrated in FIG. 16A is formed by arranging one unit cell at a leading edge portion in the sub-scanning direction and further arranging unit cells such that the number of unit cells arranged in the main scanning direction is incremented by three line by line toward a trailing edge portion in the sub-scanning direction.

Figure 16C:
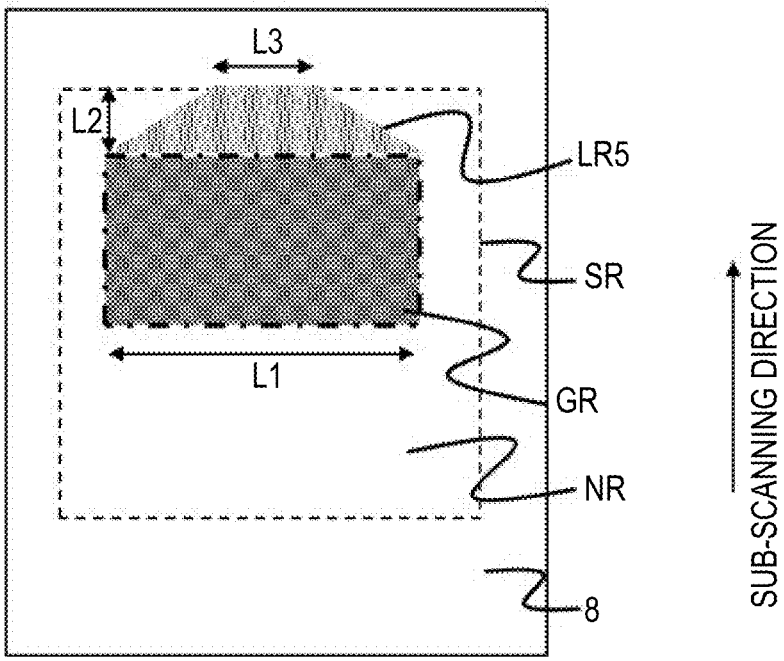

A maximum toner amount on the leading edge side in the sub-scanning direction required for suppressing the above-mentioned exposure blur ascribable to the lubricating image corresponds to about L3=100 mm illustrated for a lubricating image LR5 illustrated in FIG. 16C at the coverage rate of the minute dots illustrated in FIG. 5A. A toner amount corresponding to L3>100 mm adversely causes the exposure blur ascribable to the lubricating image to occur due to the sudden change in frictional force from the state without toner to the state with toner. In FIG. 16C, L1 is 200 mm, and L2 is 36 mm.

Figure 17A:
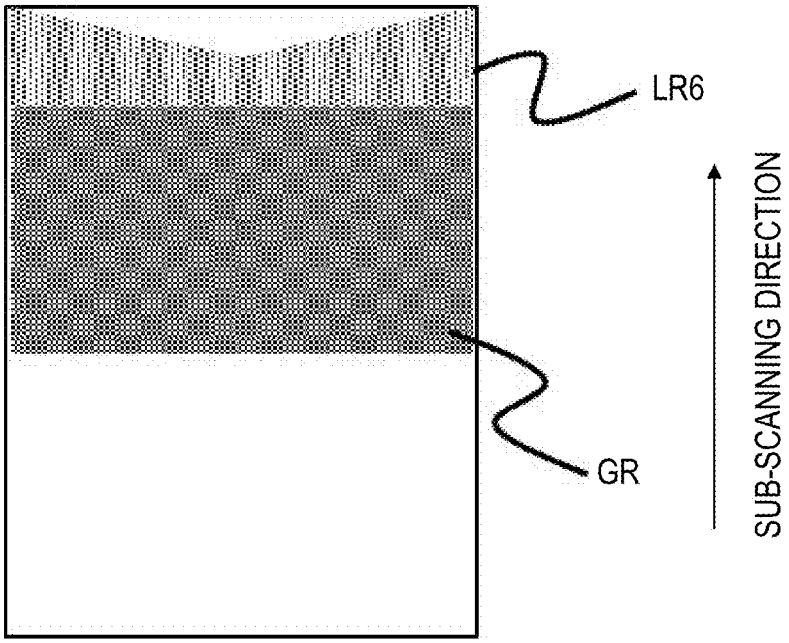
FIG. 17A and FIG. 17B are schematic views for illustrating embodiments of the lubricating image.
Figure 17B:
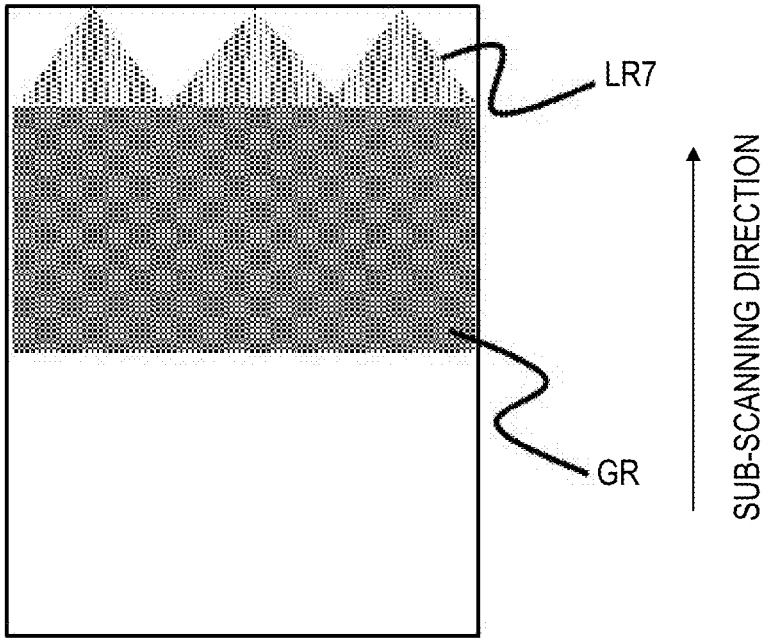

FIG. 17A is a schematic view of an example of the lubricating image formed in accordance with the fourth embodiment. In the example illustrated in FIG. 17A, a lubricating image LR6 is formed on the leading edge side in the sub-scanning direction by being written from both ends in the main scanning direction and gradually expanded to the central portion. The start position of writing the lubricating image thus formed on the leading edge side in the sub-scanning direction is not limited to such a central portion in the main scanning direction as illustrated in FIG. 16A. The same effect can also be obtained by forming a lubricating image LR7 from freely-set three points in the main scanning direction as illustrated in FIG. 17B.

As described above, in the fourth embodiment, the toner amount of the lubricating image on the trailing edge side in terms of the sub-scanning direction is controlled to become larger than the toner amount of the lubricating image on the leading edge side in terms of the sub-scanning direction. Accordingly, it is possible to suppress an occurrence of exposure blur ascribable to an original image while suppressing the exposure blur ascribable to the toner image for lubrication.

Fifth Embodiment

Next, another embodiment of the present disclosure is described. Basic configuration and operation of an image forming apparatus according to a fifth embodiment of the present disclosure are the same as those of the image forming apparatus according to the first embodiment. Therefore, elements of the image forming apparatus according to the fifth embodiment that have the same or corresponding functions or configurations as those of the image forming apparatus according to the first embodiment are denoted by the same reference symbols as those of the first embodiment, and detailed description thereof is omitted herein.

In the fifth embodiment, a density of the lubricating image on the leading edge side is controlled to become lower than a density of the lubricating image on the trailing edge side in terms of the sub-scanning direction.

Figure 18:
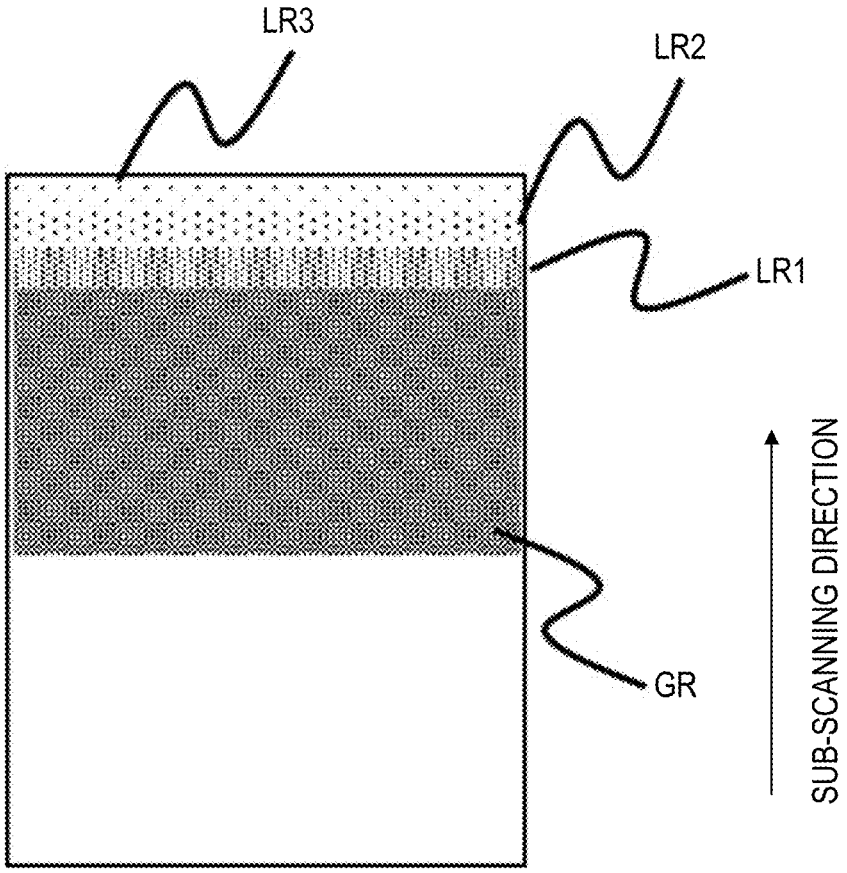
FIG. 18 is a schematic view for illustrating an embodiment of the lubricating image.

FIG. 18 is a schematic view of an example of the lubricating image formed in accordance with the fifth embodiment. The control portion 80 forms a lubricating image LR1, a lubricating image LR2, and a lubricating image LR3 having different densities on the leading edge side of the image region GR. The lubricating image LR1 is a lubricating image region formed of minute dots described in the first embodiment with reference to FIG. 5A, and has a coverage rate of 0.5%. The lubricating image LR2 on the leading edge side of the lubricating image LR1 has a coverage rate of 0.25%, which is half of the coverage rate of the lubricating image LR1, to thereby reduce the density. A coverage rate of the lubricating image LR3 further on the leading edge side is 0.125%, that is, was set to a quarter density of the lubricating image LR1. Such a decrease in density of the lubricating image on the leading edge side in the sub-scanning direction can suppress the occurrence of the exposure blur ascribable to the lubricating image.

A maximum coverage rate on the leading edge side in the sub-scanning direction required for suppressing the above-mentioned exposure blur ascribable to the lubricating image is about 0.25%. When the coverage rate becomes higher than 0.25%, the frictional force suddenly changes from the state without toner to the state with toner, and hence the exposure blur ascribable to the lubricating image occurs. The toner amount corresponding to the coverage rate of 0.25% corresponds to a toner amount obtained when the region of L3=100 mm illustrated in FIG. 16C is covered by the minute dots at a coverage rate of 0.5% described in the first embodiment.

As described above, in the fifth embodiment, the density of the lubricating image on the leading edge side in terms of the sub-scanning direction is controlled to become lower than the density of the lubricating image on the trailing edge side in terms of the sub-scanning direction. Accordingly, it is possible to suppress an occurrence of exposure blur ascribable to an original image while suppressing the exposure blur ascribable to the toner image for lubrication.

[Others]

The present disclosure is described above by way of specific embodiments. However, the present disclosure is not limited to the embodiments described above.

In the above-mentioned embodiments, the lubricating image is formed with yellow toner, but the present disclosure is not limited thereto. For example, the image forming apparatus may be provided with an image forming portion configured to form a toner image through use of transparent toner, to thereby use the image forming portion to form a lubricating image through use of transparent toner. The image forming portion configured to form the toner image with the transparent toner can have the same configuration and operation as those described in the above-mentioned embodiments. This enables the lubricating image to become more difficult to be visually recognized. When a lubricating image is formed with transparent toner, it is also preferred that the image forming portion configured to form the toner image with the transparent toner be located on most upstream among a plurality of image forming portions.

Further, a lubricant image provided between an image bearing member and an intermediate transfer member and formed to function as a lubricant, which includes the toner image for lubrication formed of the pattern of minute dots, is not required to be formed of toner. The lubricant image may be formed of, for example, a toner additive represented by zinc stearate, graphite fluoride represented by CEFBON (manufactured by Central Glass Co., Ltd.), or silicone resin fine particles represented by TOSPEARL (manufactured by Nissho Sangyo Co., Ltd.). That is, the image forming apparatus may include: the image forming portion; a lubricant image forming portion configured to form the lubricant image on a surface of the intermediate transfer member; and a control portion configured to cause the image forming portion to form the toner image for the print image based on the image information in the image portion on the intermediate transfer member, and to cause the lubricant image forming portion to form the lubricant image in the non-image portion on the intermediate transfer member in which the toner image for the print image is not to be formed, the non-image portion being located on downstream of the above-mentioned image portion in terms of the movement direction of the surface of the intermediate transfer member. The control unit can also perform control to change a lubricant amount of the lubricant image to be formed in the non-image portion based on the image information on the print image.

Further, in the above-mentioned embodiments, as an example of the lubricating image, the pattern of minute dots being a digital halftone formed by causing a laser to fully emit light based on predetermined image data is described, but the present disclosure is not limited thereto. For example, the same effect can be obtained by forming an analog halftone, for example, so-called fog toner. The analog halftone is a halftone image formed by moving toner from the developer carrying member onto the image bearing member based on a potential difference between the surface of the image bearing member and the developer carrying member to which a predetermined developing bias is applied. For example, it is possible to cause toner to be easily transferred to a part of the surface of the image bearing member by exposing the entire surface of the image bearing member to light partially with an appropriate exposure amount after charging the image bearing member, and to form the analog halftone at a desired position in terms of the main scanning direction in the same manner as in the above-mentioned embodiments. It is conceivable to form the lubricant image with each of the lubricants exemplified above by: transferring each of those lubricants charged to, for example, a polarity opposite to that of the toner to the image bearing member in the above-mentioned manner of forming the analog halftone; and further transferring the lubricant with the primary transfer bias being appropriately controlled.

Further, in the above-mentioned embodiments, the present disclosure is applied to the image forming apparatus including a plurality of image forming portions, but the present disclosure is not limited thereto. The present disclosure can also be applied to an image forming apparatus including only one image forming portion, for example, a monochromatic image forming apparatus. In this case, the lubricating image is formed by the image forming portion configured to form the print image.

Further, in the above-mentioned embodiments, a circumferential speed difference is intentionally provided between the image bearing member and the intermediate transfer member. Even with a configuration not intentionally provided with such a circumferential speed difference, a circumferential speed difference may unintentionally occur due to, for example, eccentricity of a drive roller. The present disclosure is applied to even such an image forming apparatus, to thereby be able to suppress exposure blur due to variations in rotation speed of the image bearing member depending on presence or absence of toner at the primary transfer portion.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-059019, filed Mar. 27, 2020, and Japanese Patent Application No. 2021-006083, filed Jan. 18, 2021, which are hereby incorporated by reference herein in their entirety.

What is claimed is:

1. An image forming apparatus, comprising:

an image forming portion configured to form a toner image on an image bearing member;

an intermediate transfer member which is movable and configured to form a primary transfer portion by being brought into contact with the image bearing member, and onto which the toner image primarily transferred from the image bearing member in the primary transfer portion is to be transferred to form an image portion; and a control portion configured to perform control to form a toner image for lubrication in a non-image portion, the non-image portion being a portion of a surface of the intermediate transfer member onto which the toner image for a print image based on image information is not to be formed, wherein a speed difference exists between a moving speed of a surface of the image bearing member and a moving speed of the surface of the intermediate transfer member, and wherein in a state in which the non-image portion is to be formed on a downstream side of the image portion with respect to a movement direction of the surface of the intermediate transfer member, the control portion performs control to change a size of a region for forming the toner image for lubrication based on the image information.

2. The image forming apparatus according to claim 1, wherein a value of a surface torque indicating tackiness between the image bearing member and the intermediate transfer member is greater than 0.1 N·m and less than 0.5 N·m.

3. The image forming apparatus according to claim 1, wherein the control portion performs control so that a width of the toner image for lubrication with respect to a direction intersecting the movement direction of the surface of the intermediate transfer member becomes shorter in a case in which a width of the toner image for the print image with respect to the direction intersecting the movement direction is a second width, which is shorter than a first width, than in a case in which the width of the toner image for the print image is the first width.

4. The image forming apparatus according to claim 1, wherein the control portion performs control to change a coverage rate of the toner image for lubrication based on the image information.

5. The image forming apparatus according to claim 4, wherein the control portion performs control so that the coverage rate of the toner image for lubrication becomes less in a case in which a density of the print image is a second density, which is higher than a first density, than in a case in which the density of the print image is the first density.

6. The image forming apparatus according to claim 4, wherein the control portion performs control so that the coverage rate of the toner image for lubrication becomes less in a case in which the print image is a solid image than in a case in which the print image is a halftone image.

7. The image forming apparatus according to claim 4, wherein the control portion performs control so that the coverage rate of the toner image for lubrication becomes less in a case in which the print image is a text image than in a case in which the print image is a halftone image.

8. The image forming apparatus according to claim 1, wherein the control portion performs control to change a coverage rate of the toner image for lubrication inside the region for forming the toner image for lubrication based on the image information.

9. The image forming apparatus according to claim 8, wherein the control portion sets a width of the toner image for lubrication with respect to a direction intersecting the movement direction of the surface of the intermediate transfer member according to a width of the toner image for the print image with respect to the direction intersecting the movement direction, and the control portion performs control so that a coverage rate of a second portion of the toner image for lubrication on an edge portion side with respect to the direction intersecting the movement direction becomes less than a coverage rate of a first portion of the toner image for lubrication in a central portion with respect to the direction intersecting the movement direction.

10. The image forming apparatus according to claim 1, further comprising a plurality of image forming portions disposed along the movement direction of the surface of the intermediate transfer member, wherein the toner image for lubrication is formed by at least one image forming portion among the plurality of image forming portions.

11. The image forming apparatus according to claim 10, wherein the toner image for lubrication is formed by, among the plurality of image forming portions, an image forming portion located most upstream with respect to the movement direction of the surface of the intermediate transfer member.

12. The image forming apparatus according to claim 10, wherein the plurality of image forming portions form toner images of mutually different colors, and wherein the toner image for lubrication is formed by, among the plurality of image forming portions, an image forming portion configured to form a toner image with yellow toner.

13. The image forming apparatus according to claim 10, wherein the plurality of image forming portions form toner images of mutually different colors, and wherein the toner image for lubrication is formed by, among the plurality of image forming portions, an image forming portion configured to form a toner image with transparent toner.

14. The image forming apparatus according to claim 1, wherein the toner image in the image portion which has been transferred in the primary transfer portion is conveyed by the intermediate transfer member, and the conveyed toner image is secondarily transferred to a transfer material in a secondary transfer portion, and wherein the control portion performs control to form the toner image for lubrication in a region inside a transfer material region on the intermediate transfer member to be brought into contact with the transfer material in the secondary transfer portion and outside an image region in which the toner image for the print image is to be formed.

15. The image forming apparatus according to claim 1, wherein the control portion performs control to form the toner image for lubrication so that at least a part of the toner image for lubrication and at least a part of the toner image for the print image overlap each other with respect to a direction intersecting the movement direction of the surface of the intermediate transfer member.

16. An image forming apparatus, comprising:

an image forming portion configured to form a toner image on an image bearing member;

an intermediate transfer member which is movable and configured to form a primary transfer portion by being brought into contact with the image bearing member, and onto which the toner image primarily transferred from the image bearing member in the primary transfer portion is to be transferred to form an image portion; and a control portion configured to perform control to form a toner image for lubrication in a non-image portion, the non-image portion being a portion of a surface of the intermediate transfer member onto which the toner image for a print image based on image information is not to be formed, wherein a speed difference exists between a moving speed of a surface of the image bearing member and a moving speed of the surface of the intermediate transfer member, and wherein in a state in which the non-image portion is to be formed on a downstream side of the image portion with respect to a movement direction of the surface of the intermediate transfer member, the control portion performs control so that a toner amount of the toner image for lubrication in a first region of the non-image portion near the image portion with respect to the movement direction becomes greater than a toner amount of the toner image for lubrication in a second region of the non-image portion farther from the image portion than the first region with respect to the movement direction.

17. The image forming apparatus according to claim 16, wherein the control portion performs control so that an image width of the toner image for lubrication in the first region becomes shorter than an image width of the toner image for lubrication in the second region.

18. The image forming apparatus according to claim 16, wherein the control portion performs control so that a density of the toner image for lubrication in the first region becomes lower than a density of the toner image for lubrication in the second region.

19. An image forming apparatus, comprising:

an image forming portion configured to form a toner image on an image bearing member;

an intermediate transfer member which is movable and configured to form a primary transfer portion by being brought into contact with the image bearing member, and onto which the toner image primarily transferred from the image bearing member in the primary transfer portion is to be transferred to form an image portion;

a lubricant image forming portion configured to form a lubricant image on a surface of the intermediate transfer member; and a control portion configured to perform control to form the lubricant image in a non-image portion, the non-image portion being a portion of the surface of the intermediate transfer member onto which the toner image for a print image based on image information is not to be formed, wherein a speed difference exists between a moving speed of a surface of the image bearing member and a moving speed of the surface of the intermediate transfer member, and wherein in a state in which the non-image portion is to be formed on a downstream side of the image portion with respect to a movement direction of the surface of the intermediate transfer member, the control portion performs control to change a lubricant amount of the lubricant image to be formed in the non-image portion based on the image information.

* * * * *